US009310727B2

(12) United States Patent
Masumoto et al.

(10) Patent No.: US 9,310,727 B2
(45) Date of Patent: Apr. 12, 2016

(54) IMAGE FORMING APPARATUS AND FIXING TEMPERATURE CONTROL UNIT

(71) Applicant: Konica Minolta, Inc., Chiyoda-ku (JP)

(72) Inventors: Kosuke Masumoto, Hachioji (JP); Toshiaki Tanaka, Toyokawa (JP); Yasuhiro Ishihara, Toyohashi (JP); Satoshi Chikazawa, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/559,015

(22) Filed: Dec. 3, 2014

(65) Prior Publication Data

US 2015/0160593 A1 Jun. 11, 2015

(30) Foreign Application Priority Data

Dec. 11, 2013 (JP) ..... 2013-256164

(51) Int. Cl.
*G03G 15/20* (2006.01)

(52) U.S. Cl.
CPC ..... *G03G 15/2039* (2013.01); *G03G 15/2078* (2013.01)

(58) Field of Classification Search
CPC ..... G03G 15/2039; G03G 15/205; G03G 15/2078; G03G 15/657
USPC ..... 399/69, 82, 85, 328
See application file for complete search history.

(56) References Cited

U.S. PATENT DOCUMENTS

| | | | | |
|---|---|---|---|---|
| 5,918,087 | A | 6/1999 | Kimura et al. | |
| 6,862,107 | B1 | 3/2005 | Kawai | |
| 2003/0095807 | A1 * | 5/2003 | Fujimori et al. | 399/69 |
| 2012/0114358 | A1 | 5/2012 | Sugiyama et al. | |
| 2013/0084092 | A1 | 4/2013 | Ooyanagi | |
| 2013/0209127 | A1 * | 8/2013 | Fujimoto et al. | 399/69 |

FOREIGN PATENT DOCUMENTS

| | | | |
|---|---|---|---|
| JP | 08292681 A | * | 11/1996 |
| JP | 10-39673 A | | 2/1998 |

(Continued)

OTHER PUBLICATIONS

Notification of Reasons for Refusal dated Nov. 17, 2015 issued in the corresponding Japanese Patent Application No. 2013-256164 and English translation (9 pages).

*Primary Examiner* — Robert Beatty
(74) *Attorney, Agent, or Firm* — Buchanan Ingersoll & Rooney PC

(57) ABSTRACT

An image forming apparatus forming toner images sequentially on recording sheets transported at intervals, and thermally fixing the toner images by passing the recording sheets through a fixing position on a heating roller. The target fixing temperature is determined according to information of an image on each page. When a first fixing temperature for a given page is higher than a second fixing temperature for the succeeding page and the difference therebetween is greater than a predefined value, part or all of a first period, during which the thermal fixing operation for the given page is performed, and a second period, which corresponds to an interval between the two pages, are reserved for raising the surface temperature by the difference, and temperature control is performed during the reserved periods such that the surface temperature reaches the second temperature before the thermal fixing operation for the succeeding page starts.

10 Claims, 18 Drawing Sheets

(56) References Cited

FOREIGN PATENT DOCUMENTS

| | | | | |
|---|---|---|---|---|
| JP | 2007-259466 | A | | 10/2007 |
| JP | 2011013701 | A | * | 1/2011 |
| JP | 2012-118496 | A | | 6/2012 |
| JP | 2012-242752 | A | | 10/2012 |
| JP | 2013-074495 | A | | 4/2013 |
| JP | 2013-76890 | A | | 4/2013 |
| JP | 2013-164441 | A | | 8/2013 |

* cited by examiner

FIG. 4

| Adhering toner amount (g) per page | Fixing temperature (°C) |
|---|---|
| No less than A1 | 160 |
| No less than A2 and less than A1 | 150 |
| No less than A3 and less than A2 | 135 |
| Less than A3 | 130 |

FIG. 5

| Starting temperature (℃) | Temperature increment (℃) during default period | Required power supply (W) |
|---|---|---|
| 130 | 1<br>2<br>·<br>·<br>·<br>8 | W1<br>W2<br>·<br>·<br>·<br>W8 |
| 135 | 1<br>2<br>·<br>·<br>·<br>8 | W1'<br>W2'<br>·<br>·<br>·<br>W8' |
| · | ·<br>·<br>·<br>·<br>·<br>· | ·<br>·<br>·<br>·<br>·<br>· |
| · | ·<br>·<br>·<br>·<br>·<br>· | ·<br>·<br>·<br>·<br>·<br>· |

FIG. 6

| Starting temperature (℃) | Temperature increment (℃) during thermal fixing operation period | Required power supply (W) |
|---|---|---|
| 130 | 1<br>2<br>·<br>·<br>·<br>23 | WW1<br>WW2<br>·<br>·<br>·<br>WW23 |
| 135 | 1<br>2<br>·<br>·<br>·<br>23 | WW1'<br>WW2'<br>·<br>·<br>·<br>WW23' |
| · | ·<br>·<br>·<br>·<br>·<br>· | ·<br>·<br>·<br>·<br>·<br>· |
| · | ·<br>·<br>·<br>·<br>·<br>· | ·<br>·<br>·<br>·<br>·<br>· |

IMAGE FORMING APPARATUS AND FIXING TEMPERATURE CONTROL UNIT

CROSS-REFERENCE TO RELATED APPLICATIONS

This application is based on an application No. 2013-256164 filed in Japan, the contents of which are hereby incorporated by reference.

BACKGROUND OF THE INVENTION (1) Field of the Invention

The present invention relates to image forming apparatuses such as printers and copiers, that perform printing by thermally fixing images formed on a recording sheet, and in particular to technology of controlling a fixing temperature between pages, which is applicable to an image forming apparatus that saves power by determining a target fixing temperature for each page according to the characteristics of images on the page.

(2) Description of the Related Art

In an image forming apparatus such as a printer and a copier, printing is performed by forming toner images on a recording sheet based on image data and thermally fixing the toner images by passing the recording sheet through a fixing position on a heating roller. The fixing temperature required for thermally fixing the toner images varies depending on conditions such as the amount of toner adhering to the recording sheet, and the characteristics of the images formed on the recording sheet.

In order to avoid a fixing failure under any conditions, it would be possible to set the target fixing temperature, which is the temperature to be maintained at the surface of the heating roller during the thermal fixing onto a recording sheet, to be a temperature that ensures preferable fixing even under the printing conditions that require application of the largest amount of heat. However, such a setting is not favorable in terms of power saving, because an unnecessarily large amount of power will be consumed for fixing toner images on a page that does not require such a large amount of heat.

As technology of saving power consumption, Patent Literature 1 (Japanese Patent Application No. 10-039673), for example discloses technology of changing the target fixing temperature of the surface of the heating roller for each page, depending on the characteristics of the images to be thermally fixed on the page. This technology controls the fixing temperature so as to fit the characteristics of the images on the page, thereby reducing the power consumption in the thermal fixing.

Furthermore, Patent Literature 1 (Japanese Patent Application Publication No. 2013-076890) discloses technology of reducing waiting time that occurs when changing the target fixing temperature for each page, particularly when raising the target fixing temperature.

Specifically, Patent Literature 2 discloses an image forming apparatus that, when the target fixing temperature for the succeeding page to a given page is higher than the target fixing temperature for the given page by no less than a predefined value, raises the fixing temperature step-by-step from the target fixing temperature for the page that immediately precedes the given page during the sheet interval period (i.e. the period during which the interval between two successive pages passes though the fixing position on the heating roller), thereby raising the temperature of the surface of the heating roller to the target fixing temperature for the succeeding page before performing the thermal fixing for the succeeding page.

Consequently, this technology reduces the increment of the temperature during the sheet interval period even when the difference between the target fixing temperatures for pages is large, and reduces the waiting time that occurs when raising the fixing temperature, without extending the sheet interval period.

According to the technology of waiting time reduction disclosed in Patent Literature 2, it is possible to reduce the waiting time when there is a page that immediately precedes the given page and that has the same target fixing temperature as the given page. However, if there is no such a page (e.g. when the given page is the first page), it is impossible to reduce the increment of the temperature during the sheet interval period, or to reduce the waiting time.

SUMMARY OF THE INVENTION

The present invention is made in view of the above-described problem, and aims to provide an image forming apparatus that determines the target fixing temperature for each page and that is capable of reducing the waiting time for raising the fixing temperature from the target fixing temperature for a given page to the target fixing temperature for a succeeding page regardless of the location of the given page.

To solve the above-described problem, one aspect of the preset invention provides an image forming apparatus that forms toner images sequentially on a plurality of recording sheets transported with a sheet interval therebetween, and thermally fixes the toner images by passing the recording sheets through a fixing position on a heating roller, comprising: an image information acquisition unit that acquires image information of an image on each of a plurality of pages to be printed; a fixing temperature determination unit that determines a target fixing temperature for each of the plurality of pages according to the image information, the target fixing temperature being a temperature at which a surface temperature of the heating roller is to be maintained during a thermal fixing operation for the corresponding page; and a temperature control unit that controls the surface temperature of the heating roller. When the fixing temperature determination unit determines the target fixing temperature for a given page to be a first temperature and the target fixing temperature for a succeeding page that immediately succeeds the given page to be a second temperature that is higher than the first temperature, and when a difference between the first temperature and the second temperature is greater than a predefined value, the temperature control unit reserves part or all of a first period, and a second period, the first period being a period during which the thermal fixing operation for the given page is performed, the second period being a period corresponding to a sheet interval between the given page and the succeeding page, the reserved periods serving as periods for raising the surface temperature of the heating roller by an amount that is equal to the difference. The temperature control unit performs temperature control during the reserved periods such that the surface temperature reaches the second temperature before a start of the thermal fixing operation for the succeeding page.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings:

FIG. 4 illustrates a specific example of a fixing temperature selection table;

FIG. 5 illustrates a specific example of a sheet interval temperature increment table;

FIG. 6 illustrates a specific example of a thermal fixing period temperature increment table;

DESCRIPTION OF THE PREFERRED EMBODIMENTS

Embodiment

The following explains an image forming apparatus according to one aspect of the present invention, using an example of a tandem color digital printer (hereinafter, referred to simply as "printer").

[1] Configuration of Printer

Figure 1:
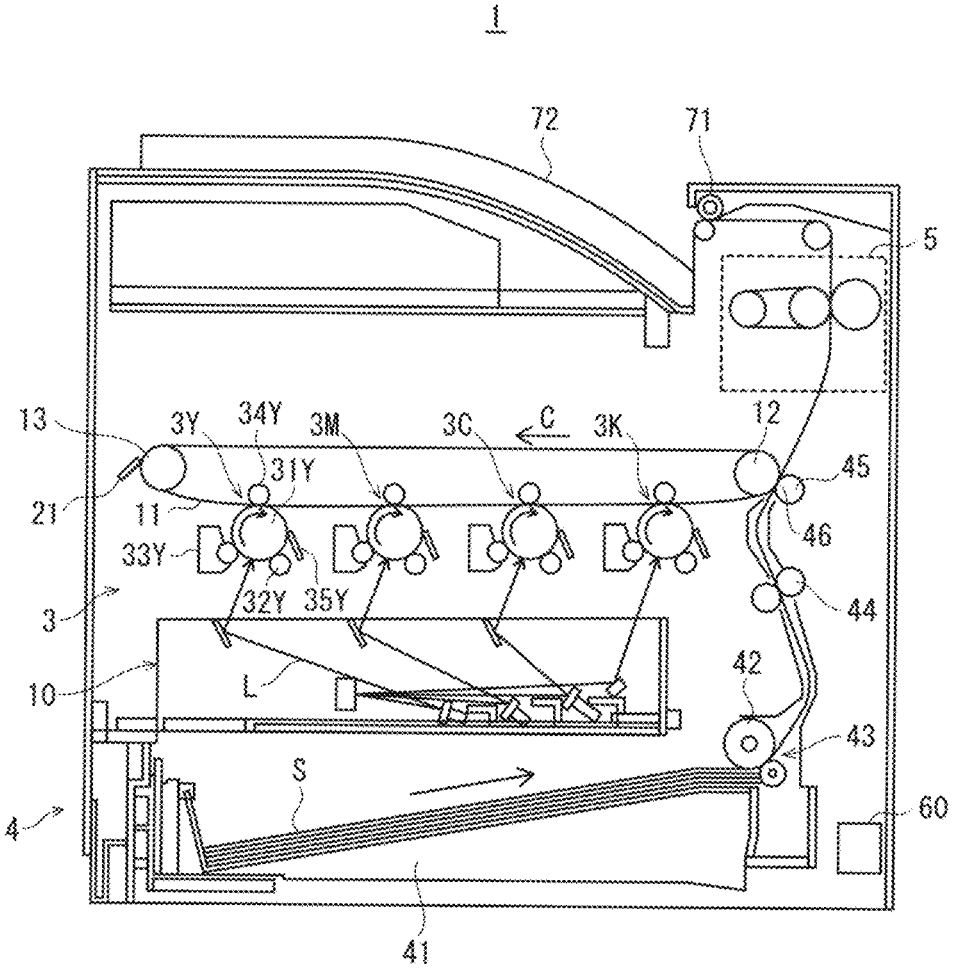
FIG. 1 illustrates a configuration of a printer 1.

First, a configuration of a printer 1 pertaining to the present embodiment is described. FIG. 1 shows a configuration of the printer 1 pertaining to the present embodiment. As shown in the drawing, the printer 1 includes an image processing unit 3, a paper feeder 4, a fixing device 5 and a controller 60.

The printer 1 is connected to a network such as a local area network (LAN). When the printer 1 receives a print command from an externally located terminal (not illustrated) or from an operation panel having a display unit (not illustrated), the printer 1 performs a printing process on a recording sheet by forming respective toner images of yellow, magenta, cyan, and black colors based on the print command, and forming a full-color image by superimposed transfer of the toner images. In the following description, the reproduction colors of yellow, magenta, cyan, and black are denoted as "Y", "M", "C" and "K", respectively, and any structural component related to one of the reproduction colors is denoted by a reference sign attached with an appropriate subscript "Y", "M", "C" or "K".

The image processing unit 3 includes image creation units 3Y, 3M, 3C, and 3K, a light-exposure unit 10, an intermediate transfer belt 11, and a secondary transfer roller 45 for example. Since the image creation units 3Y, 3M, 3C and 3K have the same configuration, the following mainly describes the configuration of the image creation unit 3Y.

The image creation unit 3Y includes a photosensitive drum 31Y and also includes a charger 32Y, a developer 33Y, a primary transfer roller 34Y, and a cleaner 35Y, which are disposed about the photosensitive drum 31Y. The cleaner 35Y is provided for cleaning the photosensitive drum 31Y. The image creation unit 3Y forms a yellow toner image on the photosensitive drum 31Y. The developer 33Y faces the photosensitive drum 31Y, and transports charged toner to the photosensitive drum 31Y. The intermediate transfer belt 11 is an endless belt wound around a drive roller 12 and a passive roller 13 in taut condition to rotatably run in the direction indicated by the arrow C. A cleaner 11 for removing toner remaining on the intermediate transfer belt 21 is provided near the passive roller 13.

The light-exposure unit 10 includes a light-emitting element such as a laser diode. A drive signal from the controller 60 causes the light-exposure unit 10 to emit laser light L for forming images of the Y, M, C, and K colors. The light-exposure unit 10 uses the laser light L to perform light-exposure scanning on the photosensitive drum in each of the image creation units 3Y, 3M, 3C, and 3K. The light-exposure scanning causes an electrostatic latent image to form on the photosensitive drum 31Y, to which an electrical charge has been applied by the charger 32Y. Note that an electrostatic latent image is formed in the same way on the photosensitive drum in each of the image creation units 3M, 3C, and 3K.

The electrostatic latent images formed on the photosensitive drums are developed by the respective developers of the image creating units 3Y, 3M, 3C and 3K. As a result, toner images are formed on the photosensitive drums in the corresponding colors. The toner images thus formed are subject to primary transfer by the respective primary transfer rollers of the image creating units 3Y, 3M, 3C and 3K, by which the toner images are transferred onto precisely the same position on the surface of the intermediate transfer belt 11 with appropriately adjusted timing (Note that, in FIG. 1, only the primary transfer roller corresponding to the image creating unit 3Y is given the reference sign 34Y, and the other primary transfer rollers are not given a reference sign). After the primary transfer, the toner images on the intermediate transfer belt 11 are subject to secondary transfer, by which the toner images are collectively transferred onto a recording sheet due to the effect of electrostatic force caused by the secondary transfer roller 45.

After secondary transfer of the single toner image onto the recording sheet, the recording sheet is conveyed to the fixing device 5. The fixing device 5 thermally fixes the toner image (unfixed image) to the recording sheet through application of heat and pressure. After fixing by the fixing device 5, an ejection roller 71 ejects the recording sheet onto an ejection tray 72.

The paper feeder 4 includes for example: a paper feed cassette 41 for storing recording sheets (indicated by the sign S in FIG. 1); a pickup roller 42 that picks up a recording sheet S from the paper feed cassette 41 one sheet at a time and feeds the recording sheet S onto a transport path 43; and a pair of timing rollers 44 that adjusts the timing to transport the fed recording sheet S to a secondary transfer position 46.

It is not necessary that only one paper feed cassette is provided. The paper feeder 4 may include a plurality of paper feed cassettes. As the recording sheets, sheets of paper (standard paper, thick paper) with different sizes and film sheets such as OHP sheets. When there are a plurality of paper feed cassettes, each paper feed cassette may contain recording sheets with a different size, thickness, or material.

The timing roller 44 transports a recording sheet to the secondary transfer position 46 in accordance with the timing with which the toner images after the primary transfer onto precisely the same position on the intermediate transfer belt 11 are transferred to the secondary transfer position 46. At the secondary transfer position 46, the toner images on the intermediate transfer belt 11 are subject to secondary transfer, by which the toner images are collectively transferred by the secondary transfer roller 45 onto a recording sheet.

The rollers, such as the pickup rollers 42 and the timing rollers 44, are rotated by the power transmission mechanism such as gear wheels and belts (not illustrated) driven by a transport motor (not illustrated). The transport motor is, for example, a stepping motor whose rotation speed can be controlled accurately.

[2] Configuration of Fixing Device

Figure 2:
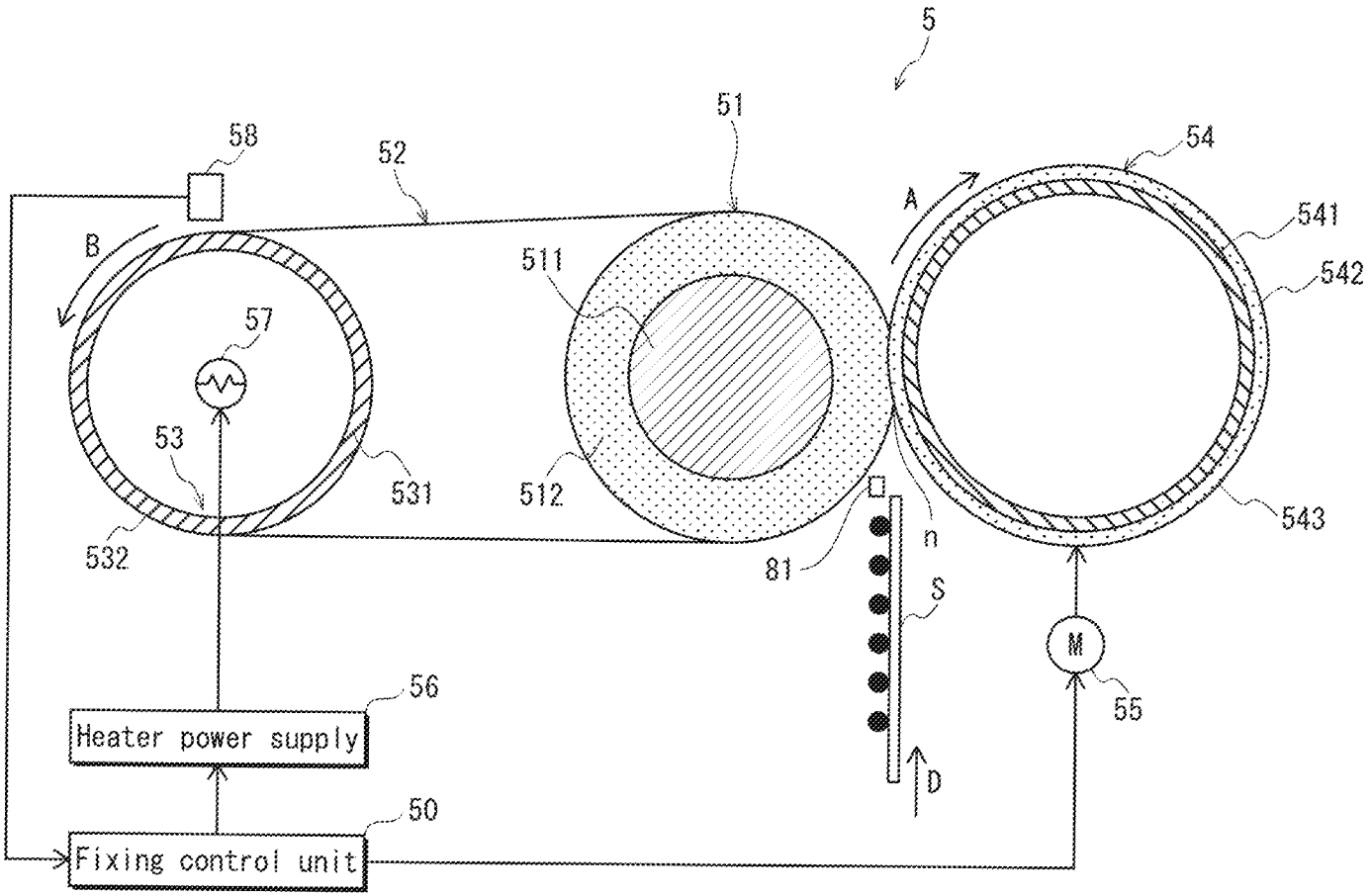
FIG. 2 is a cross-sectional view illustrating a configuration of a fixing device 5.

The configuration of the fixing device 5 is explained next. FIG. 2 is a cross-sectional view illustrating the configuration of the fixing device 5. The reference sign S in the drawing shows the recording sheet on which an unfixed image is formed. As shown in the drawing, the fixing device 5 includes: a fixing control unit 50; a fixing roller 51; a heating roller 53; a fixing belt 52 suspended with tension between the fixing roller 51 and the heating roller 53; a pressure roller 54 that presses the fixing roller 51 from the surface of the fixing belt 52 so as to form a fixing nip n; a pressure roller drive motor 55 that drives the pressure roller 54 to rotate; a heater power supply 56; a heater 57; and a temperature sensor 58, for example. The fixing control unit 50 totally controls the operations of the fixing device 5. Furthermore, a sheet sensor 81 for detecting a leading end of a recording sheet is provided upstream of the fixing nip n in the transport direction (i.e. the direction indicated by the arrow D). The sheet sensor 81 outputs the results of detection to the fixing control unit 50.

The fixing roller 51, the fixing belt 52 and the heating roller 53 are rotated in the direction indicated by the arrow B by the pressure roller 54 rotated in the direction indicated by the arrow A by the pressure roller drive motor 55. Driving of the pressure roller drive motor 55 is controlled by the fixing control unit 50, so that the rotation speeds of the fixing belt 52 and the pressure roller 54 are controlled. A temperature sensor 58 for detecting the surface temperature of the fixing belt 52 is provided in the area facing the heating roller 53 with the sheet passing region of the fixing belt 52 therebetween.

The fixing control unit 50 controls the amount of heat to be applied by the heating roller 53 according to the temperature detected by the temperature sensor 58, thereby controlling the surface temperature of the fixing belt 52 during the thermal fixing for each page, so that the surface temperature becomes the target fixing temperature for the page as determined by the controller 60 through the fixing temperature control process, which is described below. Here, the expression "target fixing temperature" refers to the temperature at which the surface temperature of the fixing belt 52 is to be maintained during the thermal fixing of each page.

When the increment of the temperature is divided in the fixing temperature control process described below into an increment during a period for performing an operation for thermal fixing for a certain page and an increment during a period corresponding to the sheet interval between the certain page and its succeeding page, which are periods reserved for raising the surface temperature of the fixing belt 52, the fixing control unit 50 controls the amount of heat to be applied by the heating roller 53 so that the surface temperature of the fixing belt 52 increases in each period by the increment allocated thereto.

Specifically, the fixing control unit 50 performs a process of raising the sheet interval temperature and a process of raising the thermal fixing period temperature, which are described later, to control the amount of heat generated by the heater 57 located inside the heating roller 53 by controlling the amount of power supply thereto, so that the surface temperature of the fixing belt 52 increases in each of the thermal fixing operation period and the sheet interval period by the increment allocated thereto. Here, the expression "the sheet interval period" refers to a period during which the interval between a given page and the succeeding page to the given page (i.e. an area between the image area of the given page and the image area of the succeeding page) passes through the fixing position (i.e. the fixing nip n). The image area mentioned here means an area on which an image can be formed.

The fixing roller 51 includes a cylindrical metal core 511 and an elastic layer 512 covering the outer circumferential surface of the metal core 511. For example, the fixing roller 51 is a roller having an outside diameter of 20 mm to 50 mm, and may be composed of the metal core 511 having a thickness of 2 mm to 5 mm and the elastic layer 512 having a thickness of 2 mm to 10 mm. The metal core 511 may be made from metal such as aluminum, steel, or stainless steel (SUS). The elastic layer 512 may be made from elastic material such as silicone rubber or silicone sponge.

The fixing belt 52 is a continuous belt that is driven to circulate, and is heated by the heating roller 53. The fixing belt 52 is brought into contact with a recording sheet S during the thermal fixing operation, thereby thermally fixing an unfixed image on the recording sheet S. The fixing belt 52 includes a base layer, an elastic layer, and a release layer, stacked in this order. For example, the fixing belt 52 has an outside diameter of 60 mm to 120 mm, and may be composed of a base layer having a thickness of 50 μm to 100 μm, an elastic layer having a thickness of 50 μm to 200 μm, and a release layer having a thickness of 10 μm to 30 μm.

The base layer may be made from heat-resistant resin such as polyimide or polyamide. The elastic layer may be made from a heat-resistant elastic material such as silicone rubber. The release layer may be formed from, for example, fluoro resin such as PFA (tetrafluoroethylene•perfluoroalkylvinylether copolymer), PTFE (polytetrafluoroethylene), FEP (tetrafluoroethylene-hexafluoroethylene copolymer), or PFEP (tetrafluoroethylene-hexafluoropropylene copolymer).

The heating roller 53 includes a hollow cylindrical metal core 531 and a coating layer 532 covering the outer circumferential surface of the metal core 531. The heater 57 is located inside the metal core 531 (within the hollow). For example, the heating roller 53 is a roller having an outside diameter of approximately 25 mm (including the metal core 511 having a thickness of approximately 1 mm and the coating layer 532 having a thickness of approximately 20 μm). The metal core 531 may be made from metal such as aluminum, steel, or stainless steel (SUS). The coating layer 532 is disposed for preventing degradation of the heating roller 53 due to friction with the fixing belt 52. The coating layer 532 may be made from PTFE for example. The heater 533 may be made from a halogen heater lamp, for example.

The pressure roller 54 includes a hollow cylindrical metal core 541, a coating layer 542 covering the outer circumferential surface of the metal core 541, and a release layer 543 covering the outer circumferential surface of the release layer 543. For example, the pressure roller 54 is a roller having an outside diameter of 35 mm (including the metal core 541 having a thickness of 2 mm, the coating layer 542 having a thickness of 4 mm, and the release layer 543 having a thickness of approximately 30 μm).

The metal core 541 may be made from metal such as aluminum, steel, or stainless steel (SUS). The elastic layer 512 may be made from elastic material such as silicone rubber, silicone sponge, or fluoro rubber. The release layer 543 may be formed from the same material as the release layer of the fixing belt 52, for example.

Although not illustrated in the drawing, the fixing device 5 also includes a frame that supports and convers the fixing roller 51, the heating roller 53 and the pressure roller 54 at the longitudinal ends of each of these members. The frame has openings as necessary, for example near the entrance and the exit for recording sheets and near the areas supporting the longitudinal ends of the fixing roller 51, the heating roller 53 and the pressure roller 54.

[3] Configuration of Controller

Figure 3:
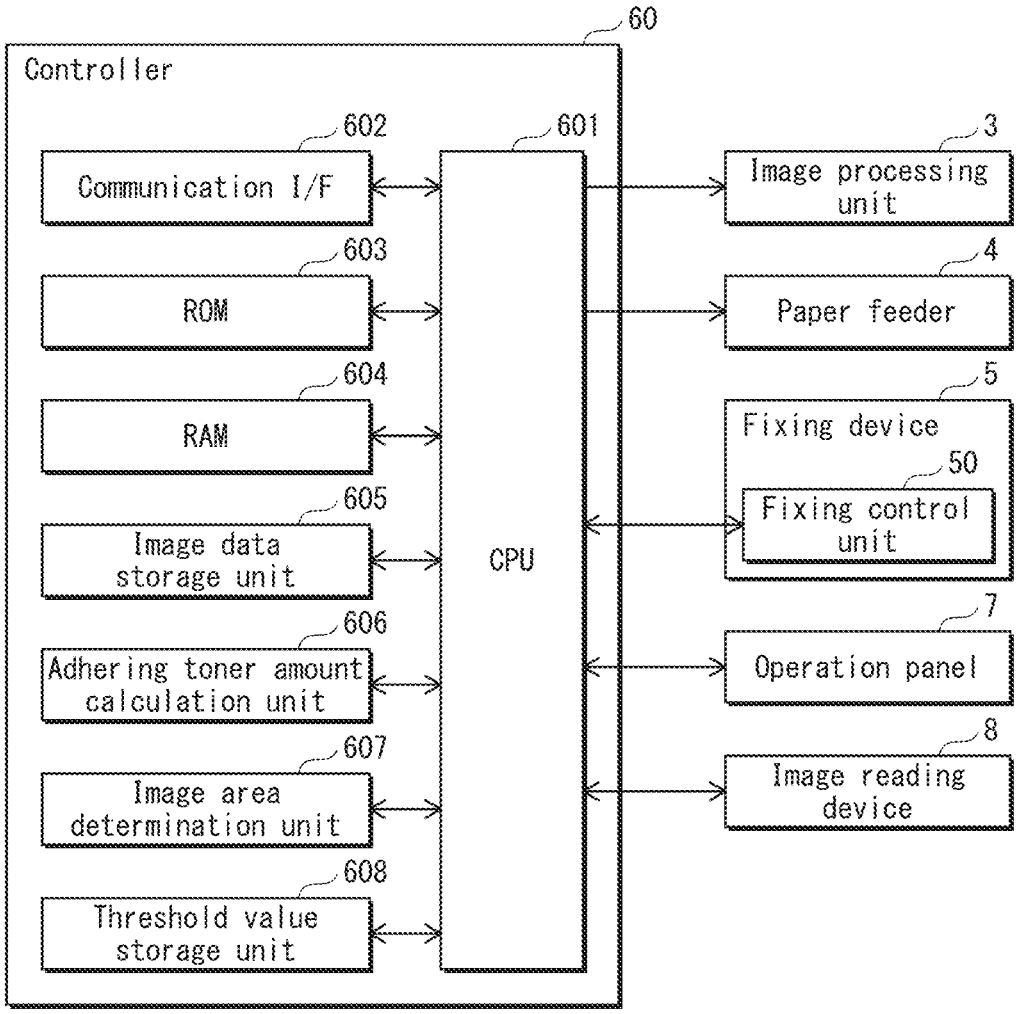
FIG. 3 shows a configuration of a controller 60 and a relationship with primary elements under the control of the controller 60.

FIG. 3 shows the configuration of the controller 60 and the relationship with primary elements under the control of the controller 60. The controller 60 is a computer for example. As shown in the drawing, the controller 60 includes, for example, a central processing unit (CPU) 601, an communication interface (I/F) 602, a read only memory (ROM) 603, a random access memory (RAM) 604, an image data storage unit 605, an adhering toner amount calculation unit 606, an image area determination unit 607, and a threshold value storage unit 608.

The communication I/F 602 is an interface for connecting to the LAN, such as a LAN card or a LAN board. The ROM 603 stores programs for controlling for example the image processing unit 3, the paper feeder 4, the fixing device 5, the operation panel 7 and the image reading device 8, programs for performing the fixing temperature control process described below, and a fixing temperature selection table.

Here, the expression "fixing temperature selection table" refers to a table showing the relationship between the amount of adhering toner per page and the target fixing temperature of the thermal fixing for the page corresponding to the amount of adhering toner. The amount of adhering toner per page is calculated by the adhering toner amount calculation unit 606. The fixing temperature selection table is used in the fixing temperature control process described below in order to determine the target fixing temperature for each page. A target fixing temperature corresponding to the adhering toner amount of a page is selected as the target fixing temperature for the page from the fixing temperature selection table. FIG. 4 illustrates a specific example of the fixing temperature selection table. In this specific example, target fixing temperatures 130° C., 135° C., 150° C. and 160° C. are associated with ranges of adhering toner amount per page.

Returning to explanation of FIG. 3, the RAM 604 is used as a work area when the CPU 601 executes programs.

The image data storage unit 605 stores image data for printing, which has been input from the communication I/F 602 or the image reading device 8.

The adhering toner amount calculation unit 605 counts, for each page and for each of the Y, M, C and K colors of the image data to be printed, the number of pixels to which toner is to be applied (hereinafter referred to as "toner application pixels"), and calculates the total number of the toner application pixels for each color. The adhering toner amount calculation unit 605 then calculates the adhering toner amount for each page by converting the total number of toner application pixels into weight.

The conversion coefficient used for the conversion into weight is determined by tests conducted in advance by the manufacturer of the printer 1, for example. Alternatively, the total number of toner application pixels for each color may be used as the adhering toner amount without conversion.

The image area determination unit 607 performs a determination for each page as to whether an image indicated by image data of the page is a text image. The determination as to whether or not the image data indicates a text image can be performed using any of various common knowledge techniques. For example, the determination can be performed by acquiring a distribution of total pixel number in a main scanning direction and a sub-scanning direction for pixels in printing image data of a single page stored in the image data storage unit 605, and by detecting periodicity in the distribution.

In the case of a text image, the total number of toner application pixels is 0 in intervals between rows and columns in which text is arranged and periodicity occurs due to sections for which the total number of toner application pixels is 0 repeating at fixed intervals in the text image. The determination described above can be performed through detection of such periodicity (refer to paragraphs 0058-0060, and FIGS. 6 and 7 of Japanese Patent Application Publication No. 2007-259466).

The image of the page is determined to be a text image when periodicity is detected throughout image data of the page, or when the image data includes a section in which periodicity is detected and a blank section. When periodicity is only detected in a section of the image (i.e., when determining that the image includes a text image section and an image section that is not a text image section (hereinafter referred to as "non-text image" section), the image is determined to not be a text image.

Examples of non-text image include pictorial images such as photo images and graphic images, and monochrome or single color solid images.

The determination is performed in the same manner as described above when the alternative determination method described below is adopted. That is, the image of the page is determined to be a text image when the image includes only a text image section or both a text image section and a blank section, and the image of the page is determined to not be a text image when the image includes only a non-text image section or both a text image section and a non-text image section.

Alternatively, the determination as to whether the image of the page is a text image can be performed using edge detection processing as described below. Edge detection processing is performed by, in turn, setting each pixel in image data of a single page as a focus pixel, extracting pixels in proximity to the focus pixel, and performing filter processing on the extracted pixels using an edge detection filter. Through the above, edge pixels which form contours of the image can be detected. Next, if an edge pixel is detected through edge detection processing, the focus pixel is determined to be an edge pixel and difference values between respective pixel values (gradation values) of the focus pixel and the pixels in proximity thereto are calculated. When at least a fixed number of the difference values are greater than a predefined threshold value, the focus pixel is determined to be an edge pixel configuring a text image. When a number of edge pixels which are determined to be configuring a text image is at least equal to a threshold value, the image of the page is determined to be a text image, and when the number of edge pixels which are determined to be configuring a text image is lower than the threshold value, the image of the page is determined to not be a text image (refer to paragraph 0065 of Japanese Patent Application Publication No. 2013-74495).

Alternatively, when image data in page description language (PDL) is acquired from the terminal, determination as to whether an image indicated by image data is a text image can be performed for each page by analyzing the PDL and determining whether commands related to text are included in the PDL (for example, a command indicating a text size or a command setting a font).

The threshold value storage unit 608 stores various kinds of threshold values used in the fixing temperature control process described below. Specifically, the threshold value storage unit 608 stores a maximum possible value of the sheet interval temperature increment, a maximum possible value of the thermal fixing period temperature increment, and a maximum value corresponding to the highest level of acceptable uneven gloss. The threshold values described above are determined by tests conducted in advance by the manufacturer of the printer 1, for example.

Here, the expression "maximum possible value of the sheet interval temperature increment" refers to the maximum possible increment of the surface temperature of the fixing belt 52 when the period corresponding to the sheet interval is a default period (e.g. 0.5 seconds), and more specifically, refers to the maximum possible increment of the surface temperature of the fixing belt 52 within the default period when the amount of power applied to the heater 57 is at the maximum (e.g. 1200 W with a duty ratio of 100%). Here, suppose that the maximum possible value of the sheet interval temperature increment is 8° C.

Note that the expression "default period" refers to the period corresponding to a default sheet interval (for example, the shortest sheet interval that is settable to the printer 1).

The expression "maximum possible value of the thermal fixing period temperature increment" refers to the maximum possible increment of the surface temperature of the fixing belt 52 during the period required for thermally fixing a toner image of a single page at the fixing nip n (i.e. the period during which an image area, within which an image for the page can be formed, passes through the fixing position (fixing nip n). This period is hereinafter referred to as "thermal fixing operation period"), and more specifically, refers to the maximum possible increment of the surface temperature of the fixing belt 52 during the thermal fixing operation period (e.g. 2 seconds) when the power supply to the heater 57 is at the maximum. Here, suppose that the maximum possible value of the thermal fixing period temperature increment is 23° C.

The expression "maximum value corresponding to the highest level of acceptable uneven gloss" refers to the maximum value of the increment of the surface temperature of the fixing belt 52 during the thermal fixing operation period, with which uneven gloss in the toner image after the thermal fixing is at the highest level within the range that is visually acceptable to naked eyes. Here, suppose that the maximum value corresponding to the highest level of acceptable uneven gloss is 15° C.

The CPU 601 performs the fixing temperature control process described below by executing the various programs stored in the ROM 603 and thereby controlling the image processing unit 3, the paper feeder 4, the fixing device 5, the operation panel 7, the image reading device 8, and so on. The CPU 601 is configured to be able to communicate with the fixing control unit 50, and controls the fixing device 5 via the fixing control unit 50.

The fixing control unit 50 includes a CPU, ROM, RAM, etc., and the ROM stores therein programs for executing the process of raising the sheet interval temperature and the process of raising the thermal fixing period temperature, which are described later, and temperature increment tables, for example. The temperature increment tables include the sheet interval temperature increment table and the thermal fixing period temperature increment table, which are created by tests conducted in advance by the manufacturer of the printer 1, for example.

The "sheet interval temperature increment table" is a table for specifying the amount of power supply required for increasing the increment of the surface temperature of the fixing belt 52 during the period corresponding to the sheet interval by the amount corresponding to the period when executing the process of raising the sheet interval temperature described below, and more specifically, shows the relationship between the surface temperature of the fixing belt 52 at the start of raising the temperature (hereinafter referred to as "the starting temperature"), the increment of the temperature during the default period, and the required amount of power supply. FIG. 5 illustrates a specific example of the sheet interval temperature increment table.

As shown in the drawing, the sheet interval temperature increment table indicates, for each of the starting temperatures, the amounts of required power supply in one-to-one correspondence with the increments of the temperature during the default period, up to the maximum possible value of the sheet interval temperature increment (8° C. in this example).

The thermal fixing period temperature increment table is a table for specifying the amount of power supply required for increasing the increment of the surface temperature of the fixing belt 52 during the period for performing an operation for thermal fixing by the amount corresponding to the period when executing the process of raising the thermal fixing period temperature described below, and more specifically, shows the relationship between the starting temperature, the increment of the temperature during the thermal fixing operation period, and the required amount of power supply. FIG. 6 illustrates a specific example of the thermal fixing period temperature increment table.

As shown in the drawing, the thermal fixing period temperature increment table indicates, for each of the starting temperatures, the amounts of required power supply in one-to-one correspondence with the increments of the temperature during the thermal fixing operation period, up to the maximum possible value of the thermal fixing period temperature increment (23° C. in this example).

Returning to explanation of FIG. 3, the operation panel 7 includes, for example, a liquid crystal display, a touch panel layered on the liquid crystal panel, and operation buttons for inputting various instructions. The operation panel 30 receives various instructions input by a user operating the touch panel, the operation buttons, and so on. The image reading device 8 includes an image input device such as a scanner. The image reading device 8 reads information on a recording sheet, such as texts, figures and pictures, and forms image data.

[4] Fixing Temperature Control Process

Figure 7:
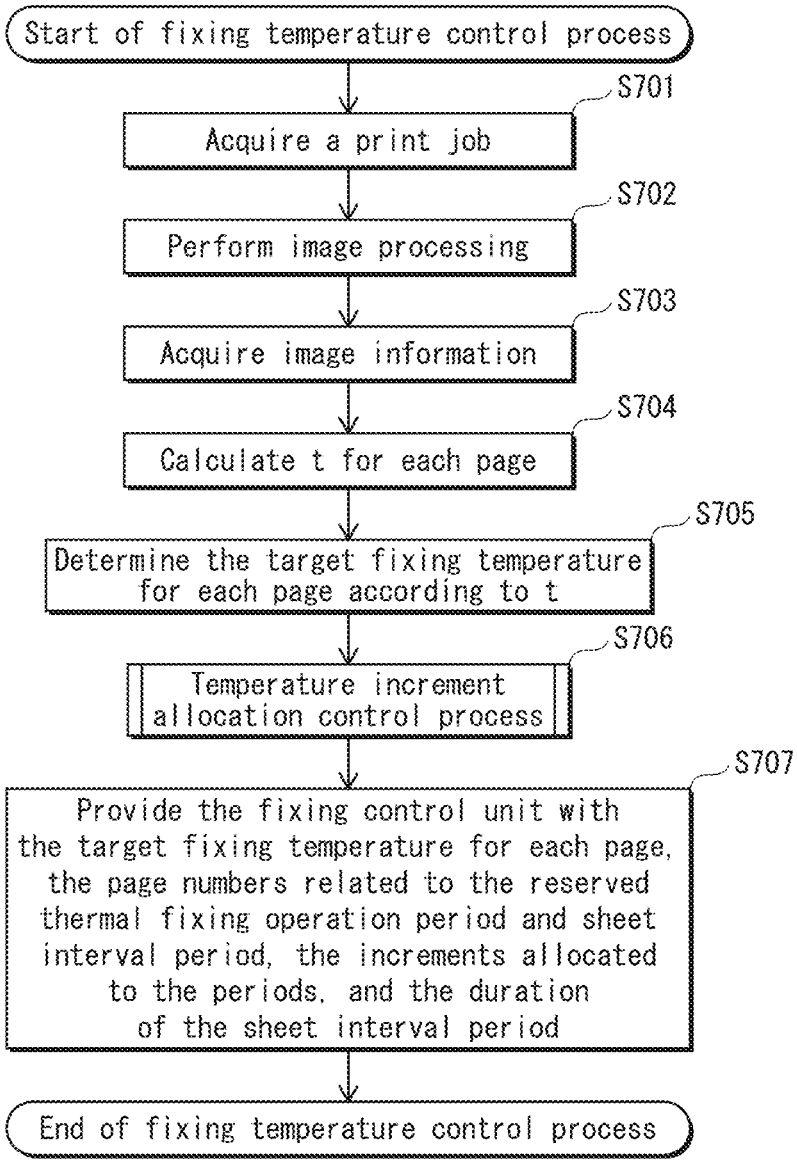
FIG. 7 is a flowchart illustrating a fixing temperature control process performed by the controller 60.

FIG. 7 is a flowchart illustrating the fixing temperature control process performed by the controller 60. Upon acquiring a print job indicating image data and print conditions via the communication I/F unit 602, the operation panel 7 or the image reading device 8 (Step S701), the controller 60 performs image processing of the image data for each page according to the print job (Step S702), and acquires image data for bitmap printing, which serves as image information (Step. S703). The controller 702 analyzes the image information, counts the number of toner application pixels for each of the Y, M, C and K colors for each page, and calculates the adhering toner amount (t) for each page (Step S704).

Next, the controller 60 determines the target fixing temperature corresponding to the adhering toner amount (t) for each page by referencing the fixing temperature selection table stored in the ROM 603 (Step S705).

The controller 60 then performs a temperature increment allocation control process (Step S706), which is described below. The controller 60 provides the fixing control unit 50 with the target fixing temperature for each page determined in Step S705 as well as the page numbers related to the thermal fixing operation period and the sheet interval period reserved in Step S706 as periods for raising the temperature, the increments allocated to the periods, and the duration of the sheet interval period (Step S707).

Figure 8:
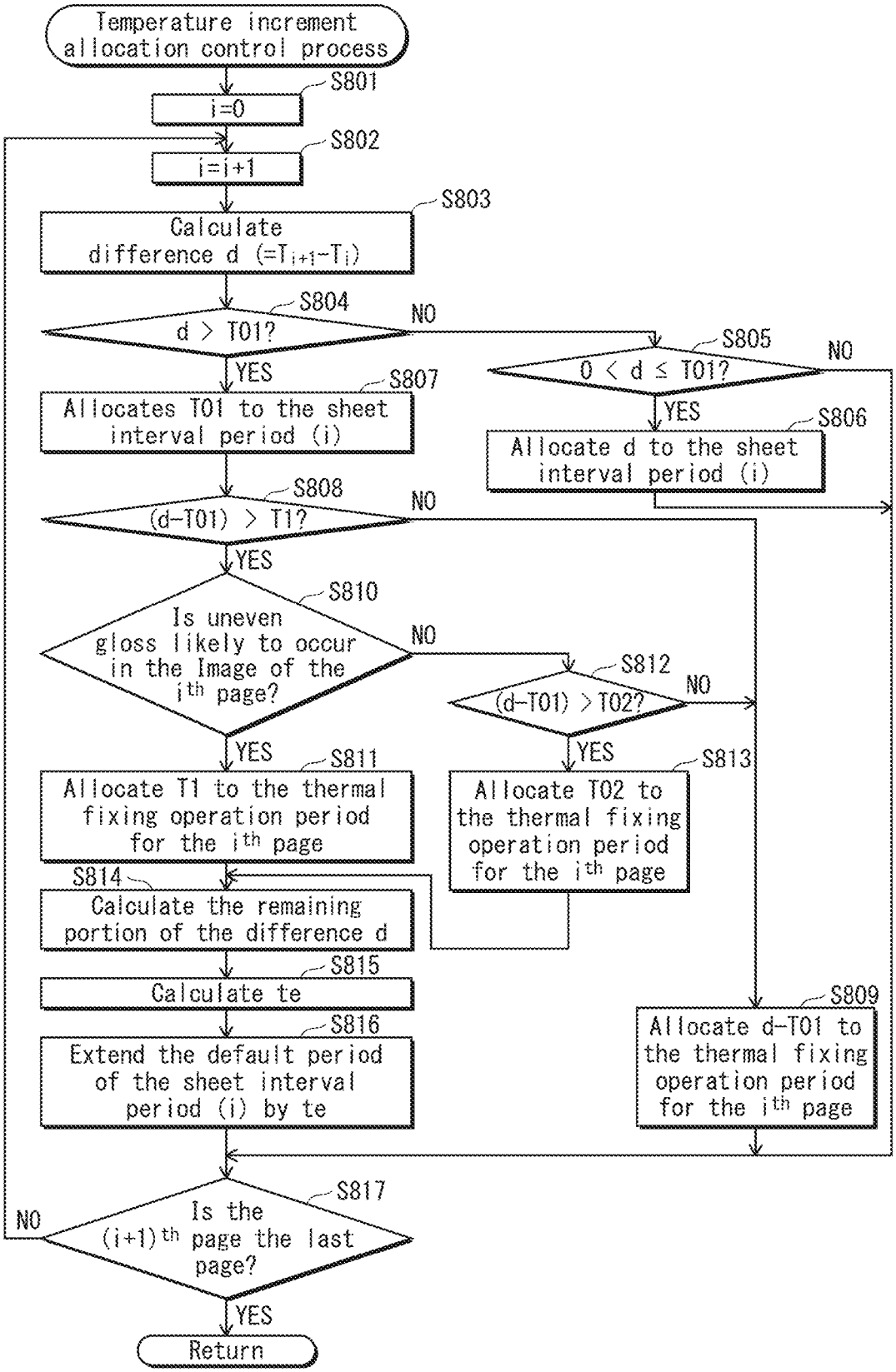
FIG. 8 is a flowchart illustrating a temperature increment allocation control process performed by the controller 60.

The following describes the temperature increment allocation control process performed by the controller 60. FIG. 8 is a flowchart illustrating the temperature increment allocation control process. The controller 60 initializes variable i to 0, which indicates the page number (Step S801), increments the variable i by 1 (Step S802), calculates difference d between target fixing temperature $T_{i+1}$ determined for the $(i+1)^{th}$ page and target fixing temperature $T_i$ determined for the $i^{th}$ page (i.e. $d=T_{i+1}-T_i$) (Step S803), and determines whether or not the difference d is greater than the maximum possible value (T01) of the sheet interval temperature increment (Step S804).

When the difference d is greater than the maximum possible value (T01) of the sheet interval temperature increment (Step S804: YES), the controller 60 reserves, as a period for raising the surface temperature of the heating roller 53 by a portion of the difference d, a sheet interval period (i) corresponding to the sheet interval between the $i^{th}$ page and the $(i+1)^{th}$ page. Note that the sheet interval period is set to be the default period by initial setting. The controller 60 allocates an increment that is equal to the maximum possible value (T01) of the sheet interval temperature increment to the sheet interval period (i) (Step S807), and determines whether the remaining portion of the difference d after allocating T01 (i.e. d−T01) is greater than the maximum value (T1) corresponding to the highest level of acceptable uneven gloss (Step S808).

When the difference d is not greater than the maximum possible value (T01) of the sheet interval temperature increment (Step S804: NO), the controller 60 furthermore performs a determination as to whether or not the difference d is greater than 0 and no greater than T01 (Step S805). When the outcome of the determination in Step S805 is affirmative (Step S805: YES), the controller 60 reserves, as a period for raising the surface temperature of the heating roller 53 by the difference d in full, a sheet interval period (i) corresponding to the sheet interval between the $i^{th}$ page and the $(i+1)^{th}$ page, and allocates the increment that is equal to the difference d to the sheet interval period (i) (Step S806).

Next, when the outcome of the determination in Step S808 is affirmative (Step S808: YES), the controller 60 performs a determination as to whether an image indicated by image data of the $i^{th}$ page is a text image by using the image area determination unit 607, thereby determining whether the image indicated by the image data of the $i^{th}$ page is an image in which uneven gloss is likely to occur (or an image in which uneven gloss is not likely to occur) (Step S810). In other words, the controller determines the image indicated by image data of the $i^{th}$ page to be "an image in which uneven gloss is likely to occur" when the image indicated by the image data of the $i^{th}$ page is not a text image, and determines the image to be "an image in which uneven gloss is not likely to occur" when the image is a text image.

Here, the expression "text image" refers to an image including only a text image section or both a text image section and a blank section. An image including both a text image section and a non-text image section is determined to not be a text image.

Then, when the outcome of the determination in Step S810 is affirmative (Step S810: YES), the controller 60 reserves, as a period for raising the surface temperature of the heating roller 53 by a portion of the difference d, a thermal fixing operation period for the $i^{th}$ page. The controller 60 allocates an increment that is equal to the maximum value (T1) corresponding to the highest level of acceptable uneven gloss to the thermal fixing operation period (Step S811), and calculates the remaining portion of the difference d (i.e. d−the total of the already allocated increments) (Step S814).

Here, when the outcome of the determination in Step S810 is negative (Step S810: NO), the controller 60 furthermore performs a determination as to whether or not the remaining portion of the difference d (i.e. d−T01) is greater than the maximum possible value (T02) of the thermal fixing period temperature increment (Step S812). When the outcome of this determination is affirmative (Step S812: YES), the controller 60 reserves, as a period for raising the surface temperature of the heating roller 53 by a portion of the difference d, the thermal fixing operation period for the $i^{th}$ page. The controller 60 allocates an increment that is equal to the maximum possible value (T02) of the thermal fixing period temperature increment to the thermal fixing operation period (Step S813), and then proceeds to Step S814. On the other hand, when the determination in Step S812 is negative (Step S812: NO), the controller 60 reserves, as a period for raising the surface temperature of the heating roller 53 by the remaining portion of the difference d, the thermal fixing operation period for the $i^{th}$ page. The controller 60 allocates the remaining portion (i.e. d−T01) to the thermal fixing operation period for the $i^{th}$ page (Step S809), and performs a determination as to whether or not the $(i+1)^{th}$ page is the last page (Step S817).

Even when the outcome of the determination in Step S808 is negative (Step S808: NO), the controller 60 proceeds to Step S817 after performing the processing in Step S809. Furthermore, when the outcome of the determination in Step S805 is negative (Step S805: NO), the controller 60 proceeds to Step S817.

Then, after calculating the still remaining portion of the difference d in Step S814, the controller 60 calculates extension time (te) (Step S815). The extension time (te) is time that needs to be added to the default period in order to raise the surface temperature by the still remaining portion of the difference d when the amount of power supply to the heater 57 is at the maximum (e.g. 1200 W with a duty ratio of 100%). The controller 60 extends the default period of the sheet interval period (i) corresponding to the sheet interval between the $i^{th}$ page and the $(i+1)^{th}$ page by the extension time (te) (Step S816), Note that the sheet interval period (i) corresponding to the sheet interval between the $i^{th}$ page and the $(i+1)^{th}$ page has been reserved as a period for raising the surface temperature by a portion of the difference d. Finally, the controller 60 proceeds to Step S817.

Figure 9:
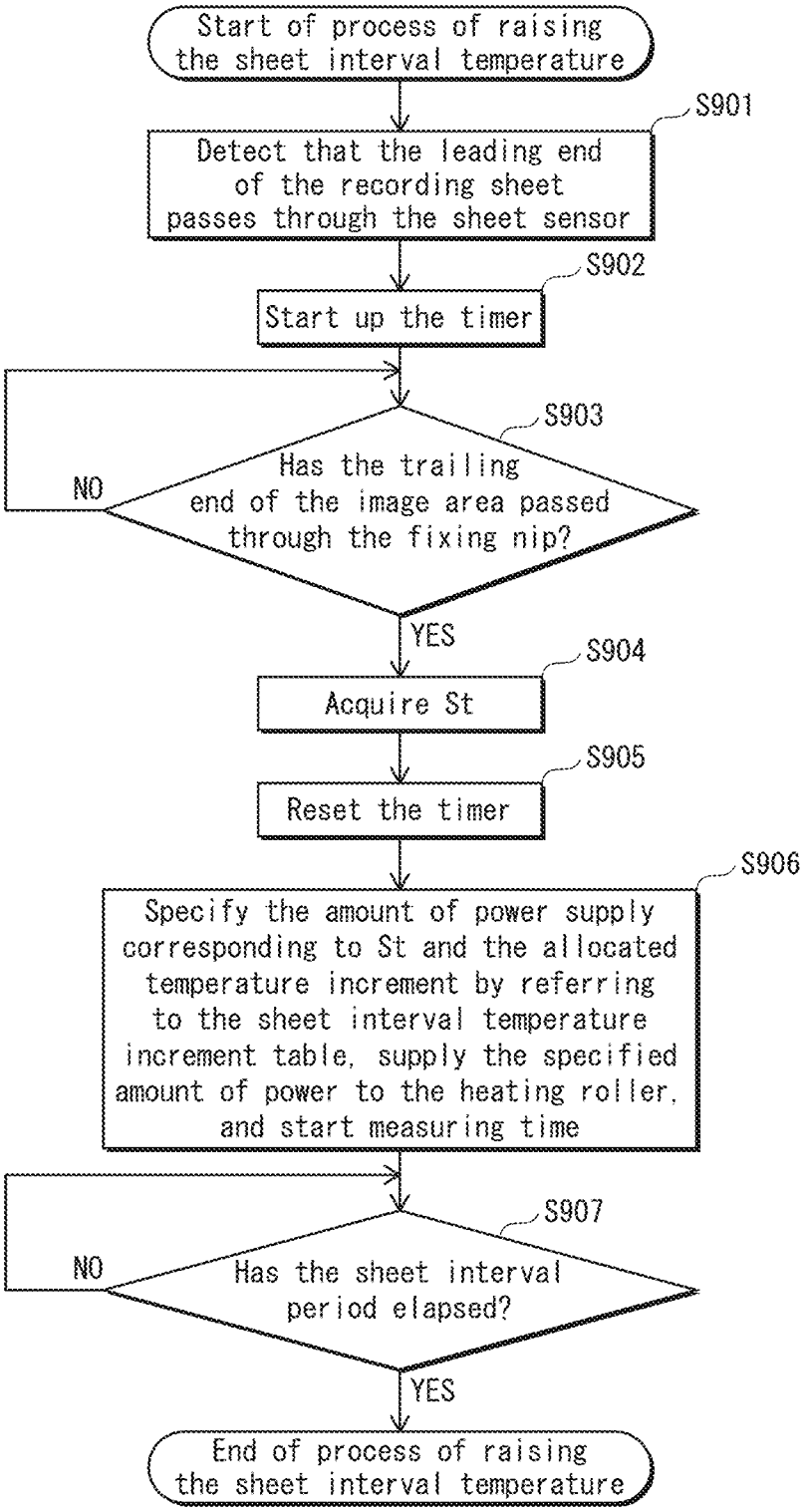
FIG. 9 is a flowchart illustrating a process of raising the sheet interval temperature, performed by a fixing control unit 50 upon receipt of a notification at Step S707 in the fixing temperature control process.

The following describes the process of raising the sheet interval temperature, performed by the fixing control unit 50 upon receipt of a notification at Step S707 in the fixing temperature control process. FIG. 9 is a flowchart illustrating the process of raising the sheet interval temperature.

The fixing control unit 50 monitors the detection by the sheet sensor 81. When detecting that the leading end of the recording sheet passes through the sheet sensor 81 (Step S901), the fixing control unit 50 starts up a first timer to start measuring time (Step S902). Note that the recording sheet mentioned above is the recording sheet with the image corresponding to the page indicated by the page number related to the thermal fixing operation period reserved as a period for raising the surface temperature (The page is hereinafter referred to as "the target page"). The fixing control unit 50 performs a determination as to whether the trailing end of the image area of the recording sheet corresponding to the target page has passed through the fixing nip n, referencing the elapsed time from the startup of the first timer (i.e. the elapsed time from when the leading end of the recording sheet corresponding to the target page passed through the sheet sensor 81) (Step S903).

Here, the time (ta) from when the leading end of the recording sheet passes through the sheet sensor 81 to when the trailing end of the image area of the recording sheet passes through the fixing nip n is measured in advance by the manufacturer of the printer 1, and measurement values of the time (ta) are stored in the ROM of the fixing control unit 50 in association with various sizes of recording sheets along the transport direction. The fixing control unit 50 performs the determination in S903 by comparing the elapsed time measured by the timer and the values of ta stored in the ROM.

Note that values of ta to be stored in the ROM of the fixing control unit 50 may be obtained in advance based on the distance between the leading end of a recording sheet and the leading end of the image area of the recording sheet, the size of the image area of the recording sheet in the transport direction, the transport speed, and the distance between the sheet sensor 81 and the fixing nip n.

When the outcome of the determination in Step S903 is affirmative (Step S903: YES), the fixing control unit 50 acquires the surface temperature (St) of the fixing belt 52 from the temperature sensor 58 (Step S904), and resets the first timer to stop measuring time (Step S905).

Next, referencing the sheet interval temperature increment table stored in the ROM, the fixing control unit 50 specifies the amount of power supply corresponding to the acquired St and the temperature increment allocated to the sheet interval period between the target page and its succeeding page (Note that when the time length of the sheet interval period has been extended from the default period, the temperature increment is converted so as to correspond to the default period), supplies the specified amount of power to the heater 57 of the heating roller 53, and starts up a second timer to start measuring time (Step S906). The fixing control unit 50 raises the surface temperature of the fixing belt 52 until the sheet interval period has elapsed (Step S907: YES). Note that the time length of the sheet interval period has been set in the fixing temperature control process.

In the meantime, in order to conform to the set time length of the sheet interval period, the controller 60 controls, for example, the speed of the image formation by the image processing unit 3, driving of the timing roller 44 to adjust timing of feeding recording sheets to the fixing device 5, and so on.

Figure 10:
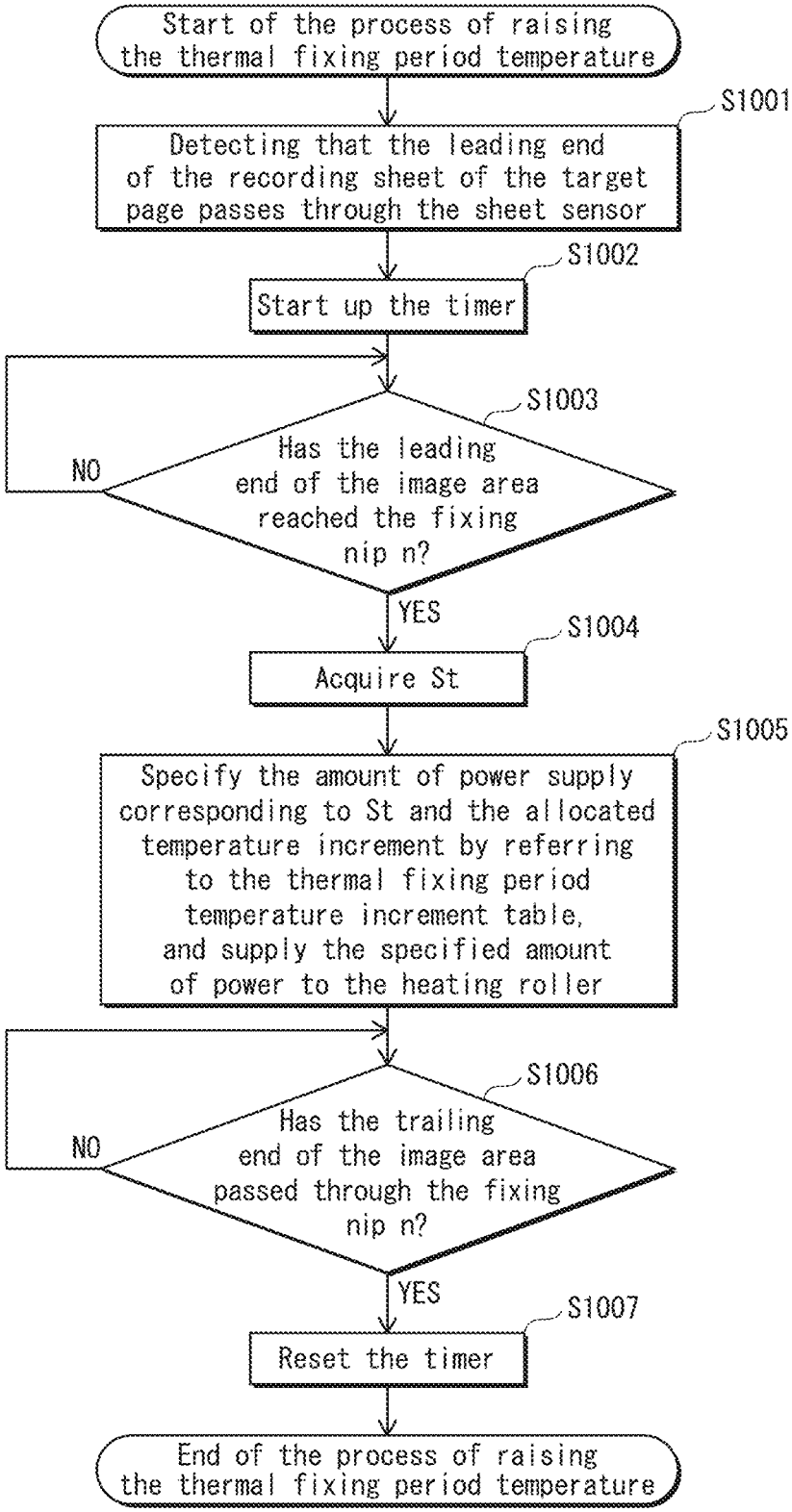
FIG. 10 is a flowchart illustrating a process of raising the thermal fixing period temperature, performed by the fixing control unit 50 upon receipt of a notification at Step S707 in the fixing temperature control process.

The following describes the process of raising the thermal fixing period temperature, performed by the fixing control unit 50 upon receipt of a notification at Step S707 in the fixing temperature control process. FIG. 10 is a flowchart illustrating the process of raising the thermal fixing period temperature.

The fixing control unit 50 monitors the detection by the sheet sensor 81. When detecting that the leading end of the recording sheet on which the image corresponding to the target page has been formed passes through the sheet sensor 81 (Step S1001), the fixing control unit 50 starts up a third timer to start measuring time (Step. S1002). The fixing control unit 50 performs a determination as to whether the leading end of the image area of the recording sheet corresponding to the target page has reached the fixing nip n, referencing the elapsed time from the startup of the third timer (i.e. the elapsed time from when the leading end of the recording sheet corresponding to the target page passed through the sheet sensor 81) (Step S1003).

Here, the time (tb) from when the leading end of the recording sheet passes through the sheet sensor 81 to when the leading end of the image area of the recording sheet passes through the fixing nip n is measured in advance by the manufacturer of the printer 1, and measurement values of the time (tb) are stored in the ROM of the fixing control unit 50. The fixing control unit 50 performs the determination in S1003 by comparing the elapsed time measured by the third timer and the values of tb stored in the ROM.

Note that values of tb to be stored in the ROM of the fixing control unit 50 may be obtained in advance based on the distance between the leading end of a recording sheet and the leading end of the image area of the recording sheet, the transport speed, and the distance between the sheet sensor 81 and the fixing nip n.

When the outcome of the determination in Step S1003 is affirmative (Step S1003: YES), the fixing control unit 50 acquires the surface temperature (St) of the fixing belt 52 from the temperature sensor 58 (Step S1004). Next, referencing the thermal fixing period temperature increment table stored in the ROM, the fixing control unit 50 specifies the amount of power supply corresponding to the acquired St and the temperature increment allocated to the thermal fixing period. The fixing control unit 50 supplies the specified amount of power to the heater 57 of the heating roller 53 (Step S1005).

Next, in the same manner as in Step S903 in FIG. 9, the fixing control unit 50 performs a determination as to whether the trailing end of the image area of the recording sheet corresponding to the target page has passed through the fixing nip n (Step S1006). When determining affirmatively (Step S1006: YES), the fixing control unit 50 resets the third timer to stop measuring time, and ends the process of raising the thermal fixing period temperature (Step S1007).

Figure 11A:
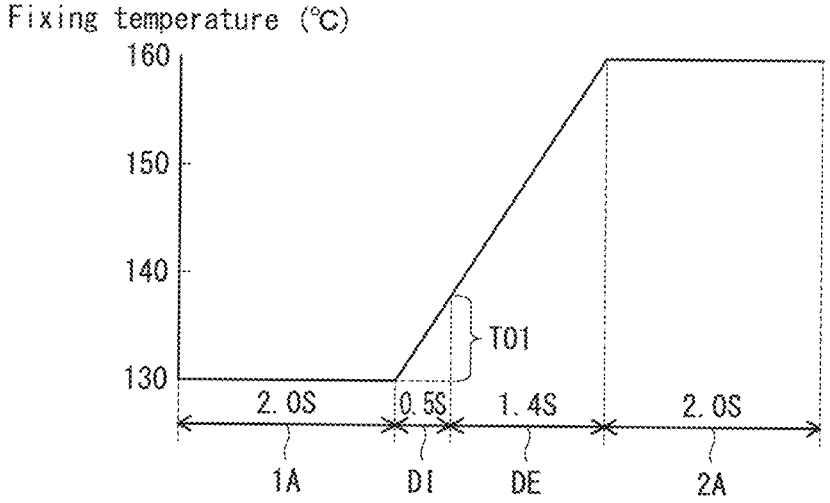
FIGS. 11A through 11C schematically illustrate specific examples of improvements in productivity in printing, owing to the fixing temperature control process.

The following describes the effect of improving the productivity in printing due to the fixing temperature control process pertaining to the present embodiment, with reference to specific examples. FIG. 11A is a schematic drawing showing an example case where the target fixing temperature for the $2^{nd}$ page (160° C.) is higher than the target fixing temperature for the $1^{st}$ page (130° C.) by 30° C. and the fixing temperature is raised to the target fixing temperature for the $2^{nd}$ page using only the sheet interval period corresponding to the interval between the two pages.

In the drawing, the double-headed arrow 1A indicates the thermal fixing operation period for the $1^{st}$ page, the double-headed arrow DI indicates the default period, the double-headed arrow DE indicates the extension time (hereinafter referred to as "sheet interval extension time") by which the default period needs to be extended in order to raising the fixing temperature to the target fixing temperature for the $2^{nd}$ page, and the doubled-headed arrow 2A indicates the thermal fixing operation period for the $2^{nd}$ page.

In the drawing, the thermal fixing operation periods 1A and 2A are 2.0 seconds, the default period DI is 0.5 seconds, and the maximum possible value (T01) of the sheet interval temperature increment is 8° C. As shown in the drawing, when the temperature is raised under these conditions, it is necessary to extend the sheet-interval period by 1.4 seconds from the default period DI (i.e. to set the sheet interval extension time DE to be 1.4 seconds, thereby setting the sheet interval period corresponding to the interval between the $1^{st}$ page and the $2^{nd}$ page to be 1.9 seconds) in order to raise the temperature to the target fixing temperature for the $2^{nd}$ page.

Figure 11B:
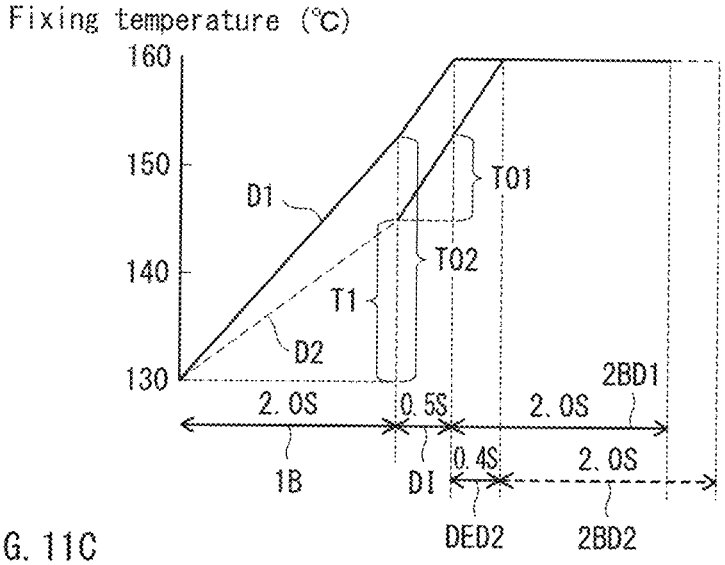

Similarly to FIG. 11A, FIG. 11B is a schematic drawing showing an example case where the target fixing temperature for the 2nd page (160° C.) is higher than the target fixing temperature for the 1st page (130° C.) by 30° C. and the fixing temperature is raised to the target fixing temperature for the 2nd page by the fixing temperature control process pertaining to the present embodiment.

In the drawing, the double-headed arrow 1B indicates the thermal fixing operation period for the 1st page, the double-headed arrow DI indicates the default period, the double-headed arrow DED2 indicates the sheet interval extension time when the image of the $1^{st}$ page is an image in which uneven gloss is likely to occur, the doubled-headed arrow 2BD1 indicates the thermal fixing operation period for the 2nd page when the image of the $1^{st}$ page is an image in which uneven gloss is unlikely to occur, and the dotted double-headed arrow 2BD2 indicates the thermal fixing operation period for the $2^{nd}$ page when the image of the $1^{st}$ page is an image in which uneven gloss is likely to occur. The inclination of the straight line segment indicated by the reference sign D1 in the drawing shows the rate of temperature rise during the thermal fixing operation period when the image of the $1^{st}$ page is an image in which uneven gloss is unlikely to occur. The inclination of the dotted straight line segment indicated by the reference sign D2 is the rate of temperature rise during the thermal fixing operation period when the image of the $1^{st}$ page is an image in which uneven gloss is likely to occur.

In the drawing, as in FIG. 11A, the thermal fixing operation periods 2BD1 and 2BD2 are 2.0 seconds, the default period DI is 0.5 seconds, and the maximum possible value (T01) of the sheet interval temperature increment is 8° C. The maximum possible value (T02) of the thermal fixing period temperature increment is 23° C., and the maximum value (T1) corresponding to the highest level of acceptable uneven gloss is 15° C.

As shown in the drawing, when the fixing temperature control process pertaining to the present embodiment is used, it is possible to raise the fixing temperature to the target fixing temperature for the $2^{nd}$ page within a shorter sheet interval period (e.g. 0.5 seconds to 0.9 seconds) than when only the sheet interval period is used as shown in FIG. 11A.

Specifically, when the image of the $1^{st}$ page is a text image, in which uneven gloss is unlikely to occur, the temperature increment during the thermal fixing operation period (the increment with the temperature rise rate D1) is equal to T02 (23° C.), and the increment to be allocated to the default period (7° C.) is no greater than the maximum possible value (T01) of the sheet interval temperature increment, which is 8° C. Thus, it is possible to raise the fixing temperature to the target fixing temperature for the $2^{nd}$ page within the default period. Therefore, it is unnecessary to extend the default period (0.5 seconds) in order to raising the fixing temperature to the target fixing temperature for the $2^{nd}$ page.

Similarly, when the image of the 1st page includes a non-text image, in which uneven gloss is likely to occur, the temperature increment during the thermal fixing operation period (the increment with the temperature rise rate D2) is equal to T1 (15° C.), and the increment to be allocated to the default period is 15° C. Thus, the increment to be allocated to the default period is smaller than in the case shown in FIG. 11A (22° C.), and accordingly it is possible to raise the fixing temperature to the target fixing temperature for the $2^{nd}$ page with shorter sheet interval extension time DED2 (0.4 seconds) than the sheet interval extension time DE (1.4 seconds) of the case shown in FIG. 11A.

As described above, according to the fixing temperature control process pertaining to the present embodiment, when the target fixing temperature for the succeeding page to a given page is higher than the target fixing temperature for the given page, and the difference between these temperatures is greater than the maximum possible value of the sheet interval temperature increment, the thermal fixing operation period for the given page and the sheet interval period corresponding to the interval between the two pages are reserved as periods for raising the temperature by the increment that is equal to the difference, and increments are allocated to these periods. Therefore, even when the difference between the target fixing temperatures of the two pages is large, the increment during the sheet interval period can be reduced. Consequently, the fixing temperature control process pertaining to the present embodiment reduces the waiting time caused by the operations for raising the fixing temperature during the sheet interval, and improves the productivity in printing.

Modified Examples

The present invention is explained based on the above embodiment, but the present invention is of course not limited to the embodiment. For example, the present invention may alternatively be implemented as explained in any of the following modified examples.

(1) In the fixing temperature control process pertaining to Embodiment above, a determination is performed for each page as to whether the image of the page is an image in which uneven gloss is likely to occur, and when it is determined to be an image in which uneven gloss is likely to occur, the increment of the temperature allocated to the thermal fixing operation period is set to fall within the range that does not cause uneven gloss (i.e. set to the maximum value (T1) corresponding to the highest level of acceptable uneven gloss). However, the determination described above may be performed for each of a plurality of areas of the page contiguous along a sheet transport direction, and the increments of the temperature may be allocated according to the outcome of the determination.

Figure 12:
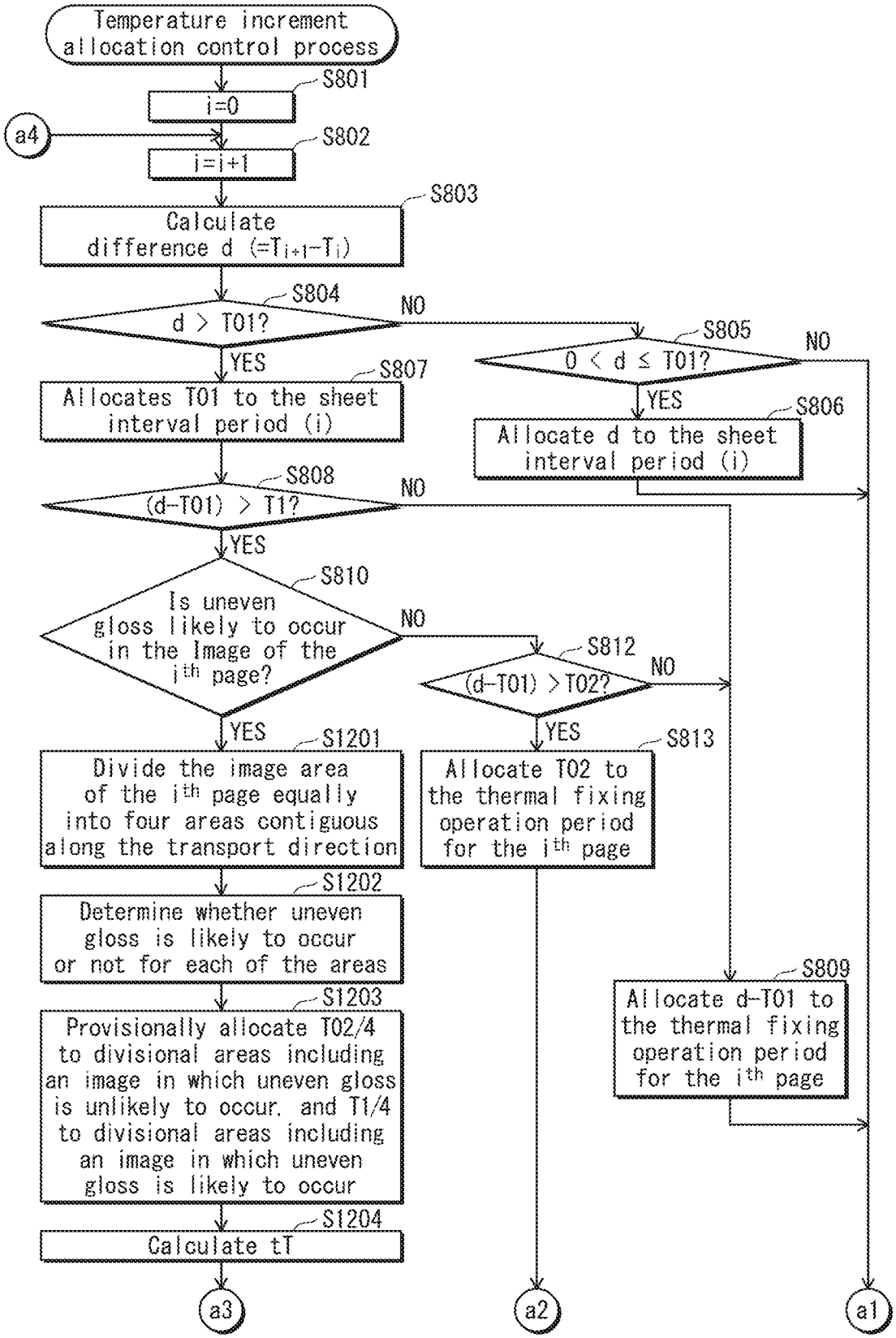
FIG. 12 is a flowchart illustrating a part of a temperature increment allocation control process pertaining to Modification 1, performed by the controller 60.
Figure 13:
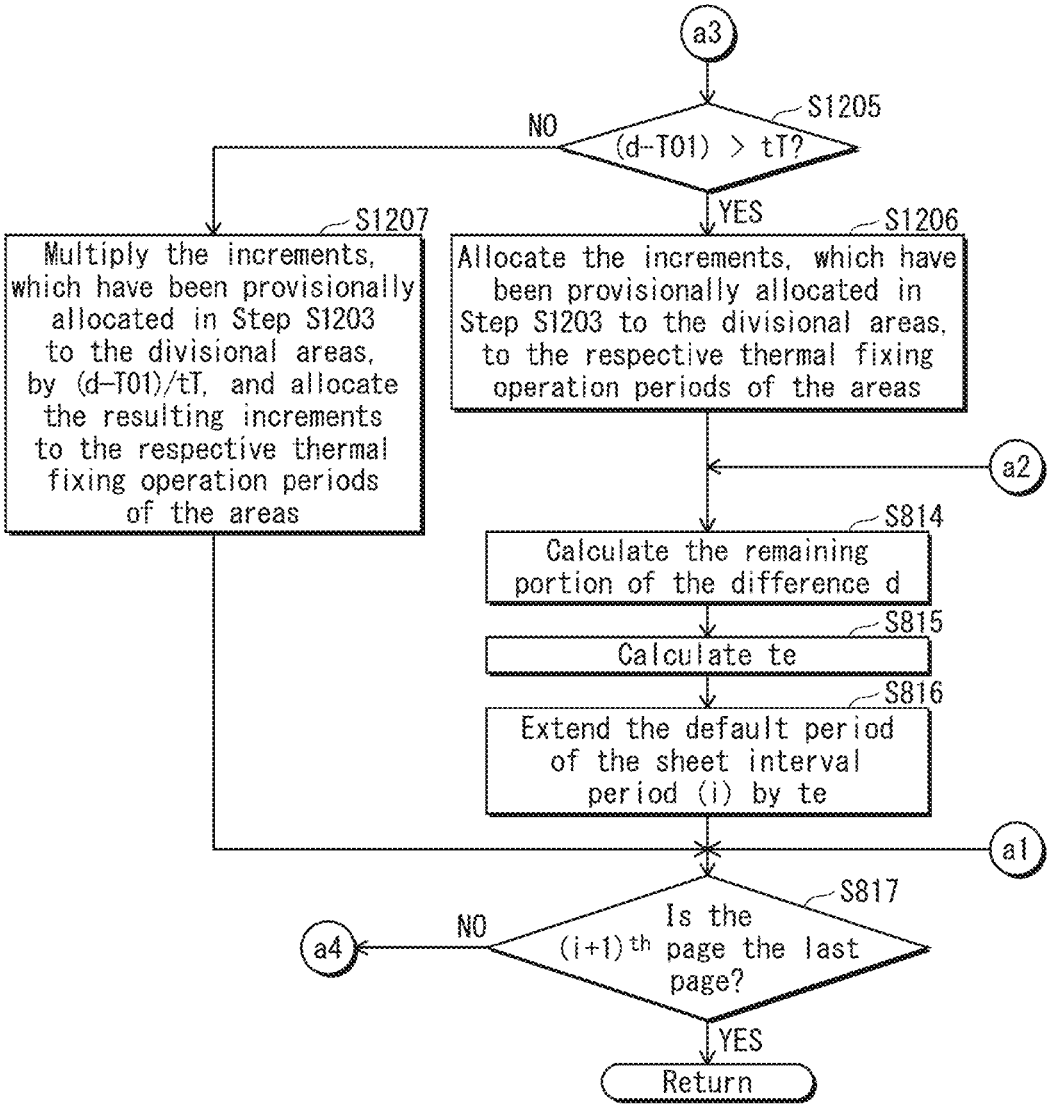
FIG. 13 is a flowchart illustrating the rest of the temperature increment allocation control process pertaining to Modification 1, performed by the controller 60.

Specifically, the image area of the page may be divided equally into four areas along the transport direction of the recording sheet, and the temperature increment allocation control process shown in FIG. 8 pertaining to Embodiment above may be modified as shown in FIG. 12 and FIG. 13. FIG. 12 and FIG. 13 are flowcharts illustrating a temperature increment allocation control process pertaining to Modification 1, performed by the controller 60. Note that steps which are the same as in the temperature increment allocation control process illustrated in FIG. 8 are labeled using the same reference signs in FIG. 12 and FIG. 13, and explanation thereof is omitted. The following explanation focuses on differences compared to the process in FIG. 8.

When the outcome of the determination in Step. S810 is affirmative (Step S810: YES), the controller 60 reserves the thermal fixing operation period of the $i^{th}$ page as a period for raising the temperature by a portion of the difference d, and divides the image area of the $i^{th}$ page formed on the recording sheet equally into four areas contiguous along the transport direction of the recording sheet (Step S1201). For each of these areas, the controller 60 performs a determination as to whether the image included in the area is a text image or not with reference to the image information of the area, thereby determining, for each of the areas, whether the image in the area is an image in which uneven gloss is likely to occur (or an image in which uneven gloss is unlikely to occur) (Step S1202).

In the following, among four areas equally divided, the area at the forefront in the transportation direction is referred to as "the first divisional area", the area following the first divisional area is referred to as "the second divisional area", the area following the second divisional area is referred to as "the third divisional area", and the last area in the transport direction, following the third divisional area, is referred to as "the fourth divisional area".

To areas determined as including "an image in which uneven gloss is unlikely to occur", the controller 60 provisionally allocates T02/4 as the temperature increment during the thermal fixing operation period for the areas, and to areas determined as including "an image in which uneven gloss is likely to occur", the controller 60 provisionally allocates T1/4 as the temperature increment during the thermal fixing operation period for the areas (Step S1203), and calculates the total (tT) of the temperature increments provisionally allocated to the divisional areas (Step S1204).

Next, the controller 60 performs a determination as to whether the remaining portion of the difference d after allocating T01 (i.e. d−T01) is greater than the total (tT) of the increments provisionally allocated to the first to fourth divisional areas (Step S1205). When the outcome of the determination in Step S1205 is affirmative (Step S1205: YES), the controller 60 allocates the increments, which have been provisionally allocated in Step S1203 to the first to fourth divisional areas, to the respective thermal fixing operation periods of the areas, so that the total increment during the thermal fixing operation period for the $i^{th}$ page becomes tT (Step S1206). Then the controller 60 proceeds to Step S814.

When the outcome of the determination in Step S1205 is negative (Step S1205: NO), the controller 60 multiplies the increments, which have been provisionally allocated in Step S1203 to the first to fourth divisional areas, by the ratio of d−T01 to tT (i.e. d−T01/tT), and allocates the resulting increments to the respective thermal fixing operation periods of the areas, which constitute the thermal fixing operation period for the $i^{th}$ page (Step S1207).

Figure 14:
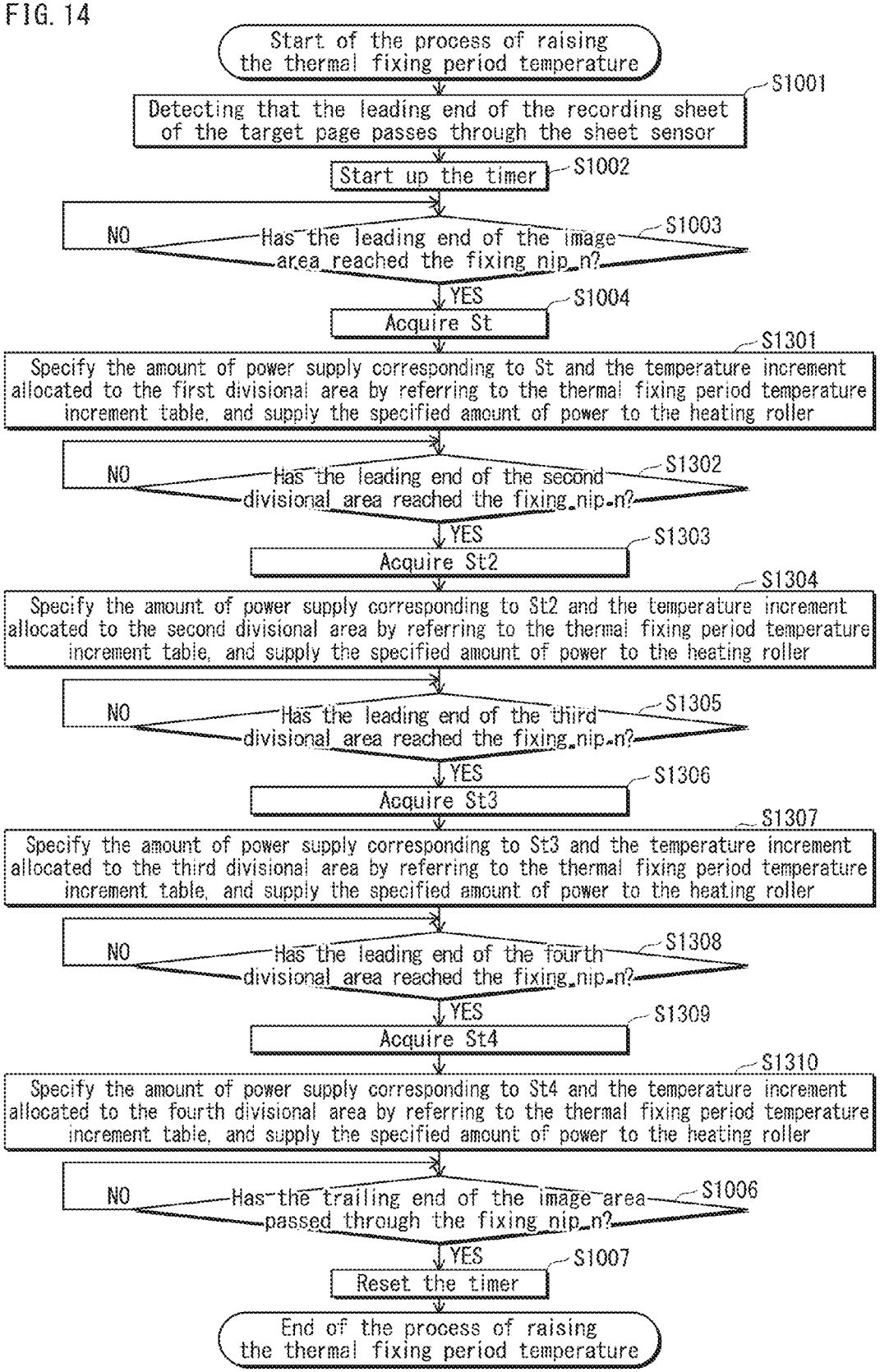
FIG. 14 is a flowchart illustrating the process of raising the thermal fixing period temperature pertaining to Modification 1 shown in FIG. 12 and FIG. 13.

FIG. 14 is a flowchart illustrating the process of raising the thermal fixing period temperature pertaining to the present modification (shown in FIG. 12 and FIG. 13). Note that the process of raising the sheet-interval period temperature pertaining to the present modification is performed in a similar manner as the process of raising the thermal fixing period temperature pertaining to Embodiment illustrated in FIG. 9.

Note that steps which are the same as in the process of raising the thermal fixing period temperature illustrated in FIG. 10 are labeled using the same reference signs in FIG. 10, and explanation thereof is omitted. The following explanation focuses on differences compared to the process in FIG. 10.

After performing the processing in Step S1004, the fixing control unit 50 refers to the thermal fixing period temperature increment table stored in the ROM, specifies the amount of power supply corresponding to the acquired St and the temperature increment allocated to the first divisional area (which is converted so as to correspond to the thermal fixing operation period. More specifically, the increment is multiplied by four) and then supplies the specified amount of power to the heater 57 of the heating roller 53 (Step S1301).

Next, the fixing control unit 50 performs a determination as to whether the leading end of the second divisional area of the recording sheet of the target page has reached the fixing nip n (Step S1302).

Here, the time (tc) from when the leading end of the recording sheet passes through the sheet sensor 81 to when the leading end of the second divisional area of the image area of the recording sheet passes through the fixing nip n is measured in advance by the manufacturer of the printer 1, and measurement values of the time (tc) are stored in the ROM of the fixing control unit 50 in association with various sizes of recording sheets along the transport direction. The fixing control unit 50 performs the determination in S1302 by comparing the elapsed time measured by the timer and the values of tc stored in the ROM and corresponding to the size of the recording sheet in the transport direction.

Note that values of tc to be stored in the ROM of the fixing control unit 50 may be obtained in advance based on the distance between the leading end of a recording sheet and the leading end of the image area of the recording sheet, the size of the image area, the transport speed, and the distance between the sheet sensor 81 and the fixing nip n.

Note that the determinations in Step S1305 and Step S1308 described below are performed in a similar manner as the determination in Step S1302.

When the outcome of the determination in Step S1302 is affirmative (Step S1302: YES), the fixing control unit 50 acquires the surface temperature (St2) of the fixing belt 52 from the temperature sensor 58 (Step S1303). The fixing control unit 50 refers to the thermal fixing period temperature increment table stored in the ROM, specifies the amount of power supply corresponding to the acquired St2 and the temperature increment allocated to the second divisional area (which is converted so as to correspond to the thermal fixing operation period in the same manner as in Step S1301), and then supplies the specified amount of power to the heater 57 of the heating roller 53 (Step S1304).

After that, when the leading end of the third divisional area of the image area of the recording sheet of the target page reaches the fixing nip n (Step S1305: YES), the fixing control unit 50 acquires the surface temperature (St3) of the fixing belt 52 from the temperature sensor 58 (Step S1306). The fixing control unit 50 refers to the thermal fixing period temperature increment table stored in the ROM, specifies the amount of power supply corresponding to the acquired St3 and the temperature increment allocated to the third divisional area (which is converted so as to correspond to the thermal fixing operation period in the same manner as in Step S1301), and then supplies the specified amount of power to the heater 57 of the heating roller 53 (Step S1307).

Finally, when the leading end of the fourth divisional area of the image area of the recording sheet of the target page reaches the fixing nip n (Step S1308: YES), the fixing control unit 50 acquires the surface temperature (St4) of the fixing belt 52 from the temperature sensor 58 (Step S1309). The fixing control unit 50 refers to the thermal fixing period temperature increment table stored in the ROM, specifies the amount of power supply corresponding to the acquired St4 and the temperature increment allocated to the fourth divisional area (which is converted so as to correspond to the thermal fixing operation period in the same manner as in Step S1301), and then supplies the specified amount of power to the heater 57 of the heating roller 53 (Step S1310). Then, the fixing control unit 50 proceeds to Step S1006.

In the present modification, the image area of the page is divided equally into four areas. However, this is not essential. The image area may be divided into five or more areas, or three or less areas. In addition, the image area is not necessarily equally divided insofar as the sizes of the areas are determined in advance.

As described above, according to the present modification, the image area of the page is divided into a plurality of areas contiguous along the transport direction of the recording sheet, and for each of these areas, it is determined whether the image included in the area is an image in which uneven gloss is likely to occur (or an image in which uneven gloss is unlikely to occur). To areas determined as including "an image in which uneven gloss is unlikely to occur", a large increment (T02/4) is allocated compared to the increment (T1/4) falling within the range that does not cause uneven gloss. Therefore, when compared with the case where the determination above is performed for each page, the increment during the thermal fixing operation period for the image of the page including a non-text image section is increased.

Consequently, when compared with the case where the determination above is performed for each page as in Embodiment above, the increment during the sheet interval period corresponding to the interval between a given page and its succeeding page is reduced when the image of the given page includes a non-text image section. Therefore, the fixing temperature control process pertaining to the present embodiment reduces the waiting time caused by the operations for raising the fixing temperature during the sheet interval, and improves the productivity in printing.

Figure 11C:
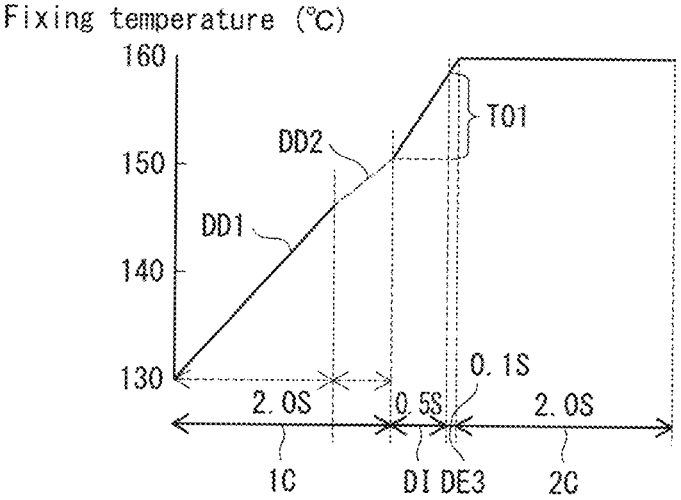

Similarly to FIG. 11A and FIG. 11B, FIG. 11C is a schematic drawing showing an example case where the target fixing temperature for the $2^{nd}$ page (160° C.) is higher than the target fixing temperature for the $1^{st}$ page (130° C.) by 30° C. and the fixing temperature is raised to the target fixing temperature for the $2^{nd}$ page by the fixing temperature control process pertaining to the present modification. In this example case, suppose that the images in the first to third divisional areas are images in which uneven gloss is unlikely to occur, and the image in the fourth divisional area is an image in which uneven gloss is likely to occur.

In the drawing, the double-headed arrow 1C indicates the thermal fixing operation period for the $1^{st}$ page, the double-headed arrow DI indicates the default period, the double-headed arrow DE3 indicates the sheet interval extension time, and the double-headed arrow 2C indicates the thermal fixing operation period for the $2^{nd}$ page. The inclination of the straight line segment indicated by the reference sign DD1 in the drawing shows the rate of temperature rise corresponding to the first to third divisional areas. The inclination of the dotted straight line segment indicated by the reference sign DD2 is the rate of temperature rise corresponding to the fourth divisional area.

In the drawing, as in FIG. 11A, the default period is 0.5 seconds, and the maximum possible value (T01) of the sheet interval temperature increment is 8° C. The thermal fixing operation period is 2 seconds, the maximum possible value (T02) of the thermal fixing period temperature increment is 23° C., and the maximum value corresponding to the highest level of acceptable uneven gloss is 15° C.

When the fixing temperature control process pertaining to the present modification is used, in the case where the image of the $1^{st}$ page is an image in which uneven gloss is likely to occur, it is possible to raise the fixing temperature to the target fixing temperature for the $2^{nd}$ page within a shorter sheet interval period (e.g. 0.6 seconds) than the case shown in FIG. 11B.

More specifically, as shown in FIG. 11C, since the temperature rise rate DD1 for the divisional areas including an image in which uneven gloss is unlikely to occur (i.e. the first to third divisional areas) can be set to be greater than the temperature rise rate DD2 for the divisional area including an image in which uneven gloss is likely to occur (i.e. the fourth divisional area), it is possible to raise the fixing temperature to the target fixing temperature for the $2^{nd}$ page with the sheet interval extension time DE3 (0.1 seconds) which is shorter than the sheet interval extension time DED2 (0.4 seconds) shown in FIG. 11B, which illustrates the case where the image of the $1^{8t}$ page is an image in which uneven gloss is likely to occur.

(2) In Embodiment above, when the difference d between the target fixing temperatures of a given page and its succeeding page is greater than the maximum possible value (T01) of the sheet interval temperature increment and it is therefore impossible to allocate the difference d in full to the thermal fixing operation period for the given page and thereby raise the fixing temperature by the difference d, the sheet interval period is extended from the default period by a period corresponding to the still remaining portion of the difference d (Step S816 in FIG. 8). However, when the preceding page to the given page has the same target fixing temperature as the given page, the sheet interval period corresponding to the interval between the preceding page and the given page and the thermal fixing operation period for the preceding page may be reserved as the periods for raising the temperature by the remaining portion of d, and the remaining portion of d may be allocated to these periods.

Figure 15:
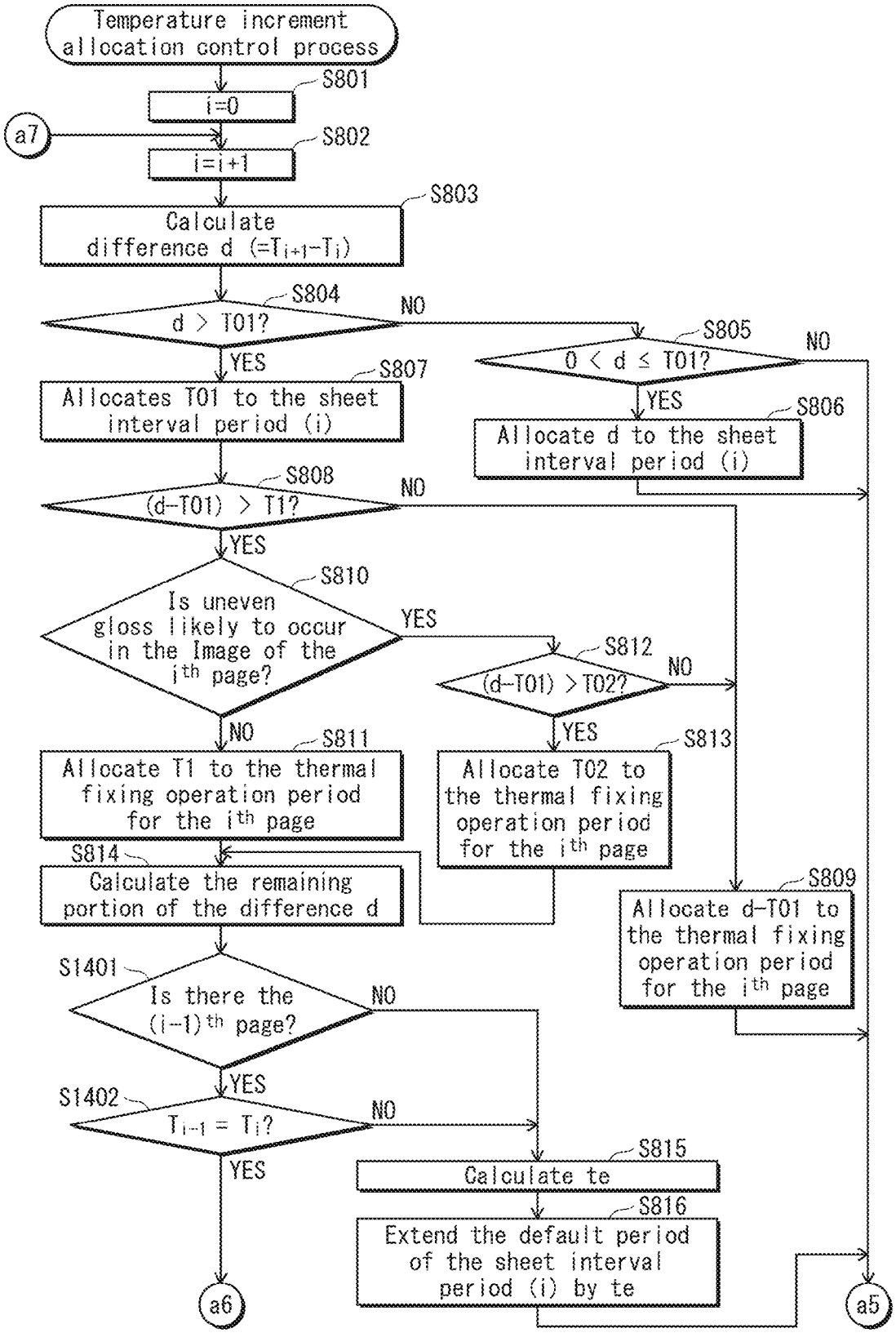
FIG. 15 is a flowchart illustrating a part of a temperature increment allocation control process pertaining to Modification 2, performed by the controller 60.
Figure 16:
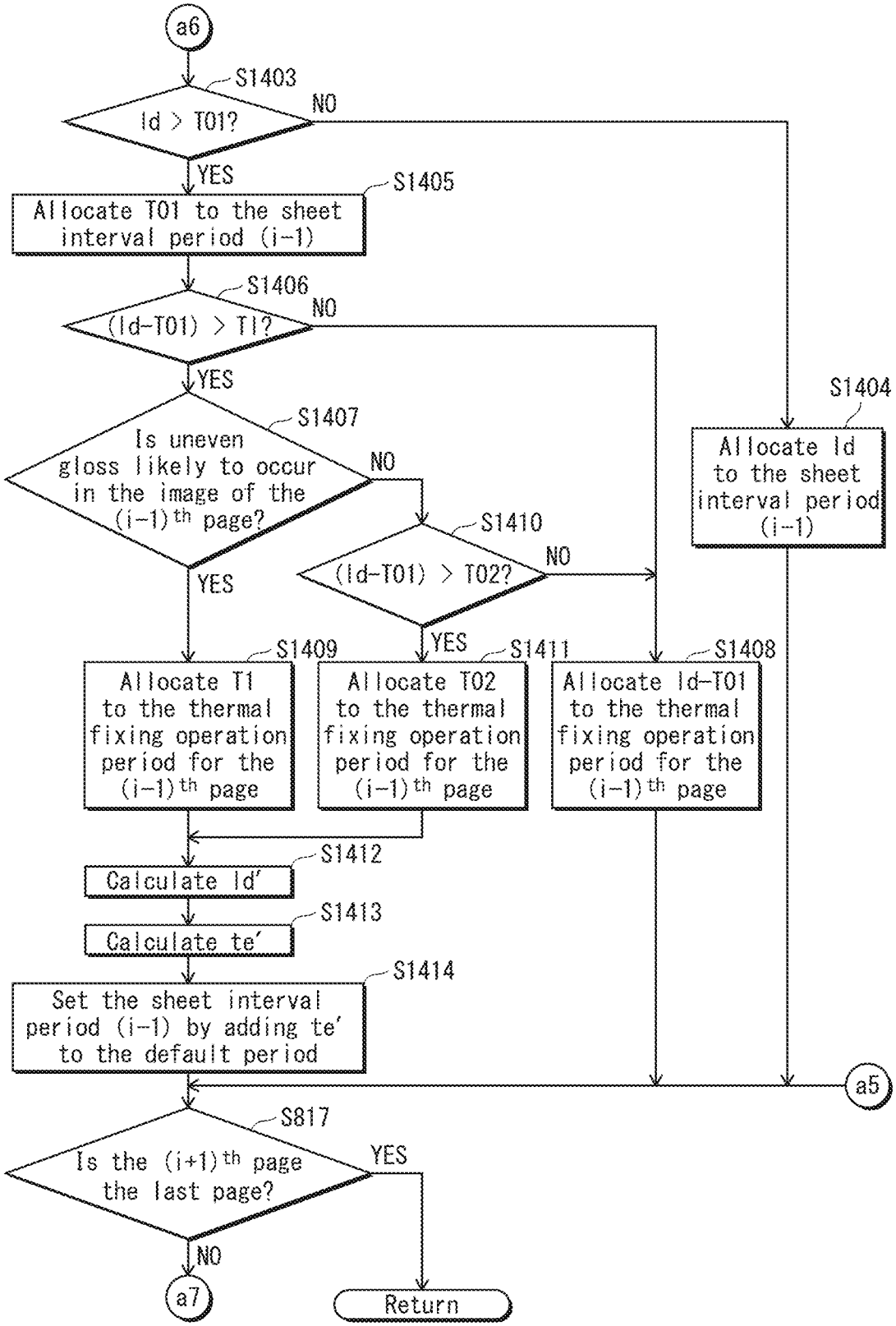
FIG. 16 is a flowchart illustrating the rest of the temperature increment allocation control process pertaining to Modification 2, performed by the controller 60.

More specifically, the temperature increment allocation control process illustrated in FIG. 8 for Embodiment may be modified as illustrated in FIG. 15 and FIG. 16. FIG. 15 and FIG. 16 are flowcharts illustrating a temperature increment allocation control process pertaining to Modification 2, performed by the controller 60. Note that steps which are the same as in the temperature increment allocation control process illustrated in FIG. 8 are labeled using the same reference signs in FIG. 15 and FIG. 16, and explanation thereof is omitted. The following explanation focuses on differences compared to the process in FIG. 8.

After performing the processing in Step S814, when there is the $(i-1)^{th}$ page (Step S1401: YES) and the target fixing temperature ($T_{i-1}$) determined for the $(i-1)^{th}$ page and the target fixing temperature ($T_i$) determined for the $i^{th}$ page are the same (Step S1402: YES), the controller 60 performs a determination as to whether the increment (1*d*) that is equal to the remaining portion of the difference d calculated in Step S814 is greater than the maximum possible value (T01) of the sheet interval temperature increment (Step S1403).

When the outcome of the determination in Step S1403 is negative (Step S1403: NO), the controller 60 reserves, as a period for raising the fixing temperature by the remaining portion of the difference d, the sheet interval period (i−1) corresponding to the interval between the $(i-1)^{th}$ page and the $i^{th}$ page, and allocates the increment (1*d*) to the sheet interval period (i−1) (Step S1404). The controller 60 then proceeds to Step S817.

When the outcome of the determination in Step S1403 is affirmative (Step S1403: YES), the controller 60 reserves, as a period for raising the fixing temperature by the remaining portion of the difference d, the sheet interval period (i−1) corresponding to the interval between the $(i-1)^{th}$ page and the $i^{th}$ page, and allocates the maximum possible value (T01) of the sheet interval temperature increment to the sheet interval period (i−1) (Step S1405). The controller 60 then performs a determination as to whether the remaining portion (1*d*−T01) of 1*d* after allocating T01 is greater than the maximum value (T1) corresponding to the highest level of acceptable uneven gloss (Step S1406).

When the outcome of the determination in Step S1406 is affirmative (Step S1406: YES), the controller performs the determination as to whether the image indicated by the image data of the $(i-1)^{th}$ page is an image in which uneven gloss is likely to occur (or an image in which uneven gloss is not likely to occur) (Step S1407) in the same manner as in Step S810 in FIG. 8.

When the outcome of the determination in Step S1406 is negative (Step S1406: NO), the controller 60 reserves, as a period for raising the fixing temperature by a portion of the remaining portion of the difference d, the thermal fixing operation period for the $(i-1)^{th}$ page, and allocates the increment (1*d*−T01) to the thermal fixing operation period (Step S1408). The controller 60 then proceeds to Step S817.

When the outcome of the determination in Step S1407 is affirmative (Step S1407: YES), the controller 60 reserves, as the period for raising the fixing temperature by the portion of the remaining portion of the difference d, the thermal fixing operation period for the $(i-1)^{th}$ page, and allocates the maximum value (T1) corresponding to the highest level of acceptable uneven gloss (Step S1409). Next, the controller 60 calculates the still remaining portion 1*d*' (i.e. (the remaining portion (1*d*) calculated in Step S814)−(the total of already allocated increments)) (Step S1412), and calculates the sheet interval extension time (te') that needs to be extended from the default period to raise the temperature by the increment 1*d*' (Step S1413). The controller 60 sets the sheet interval period (i−1) between the $(i-1)^{th}$ page and the $i^{th}$ page by adding the sheet interval extension time (te') to the default period (Step S1414). The controller 60 then proceeds to Step S817.

When the outcome of the determination in Step S1407 is negative (Step S1407: NO), the controller 60 performs a determination as to whether the above-described portion (1*d*−T01) of the remaining portion is greater than the maximum possible value (T02) of the thermal fixing period temperature increment (Step S1410). When the outcome is affirmative (Step S1410: YES), the controller reserves, as the period for raising the temperature by the portion of the remaining portion, the thermal fixing operation period for the $i-1^{th}$ page, and allocates the increment that is equal to the maximum possible value (T02) of the thermal fixing period temperature increment to the thermal fixing operation period for the $i-1^{th}$ page (Step S1411). The controller 60 then proceeds to Step S1412.

When the outcome of the determination in Step S1410 is negative (Step S1410: NO), the controller 60 proceeds to Step S1408.

Note that the process of raising the sheet-interval period temperature and the process of raising the thermal fixing period temperature are performed in a similar manner as the process of raising the sheet-interval period temperature and the process of raising the thermal fixing period temperature pertaining to Embodiment illustrated in FIG. 9 and FIG. 10.

In the modification described above, when the difference between the target fixing temperatures of a given page and its succeeding page is greater than the maximum possible value (T01) of the sheet interval temperature increment and it is therefore impossible to allocate the difference d in full to the thermal fixing operation period for the given page and thereby raise the fixing temperature by the difference d, the sheet interval period corresponding to the interval between the preceding page and the given page is preferentially reserved as the periods for raising the temperature by the remaining portion of d. However, the thermal fixing operation period for the preceding page may be preferentially reserved.

Figure 17:
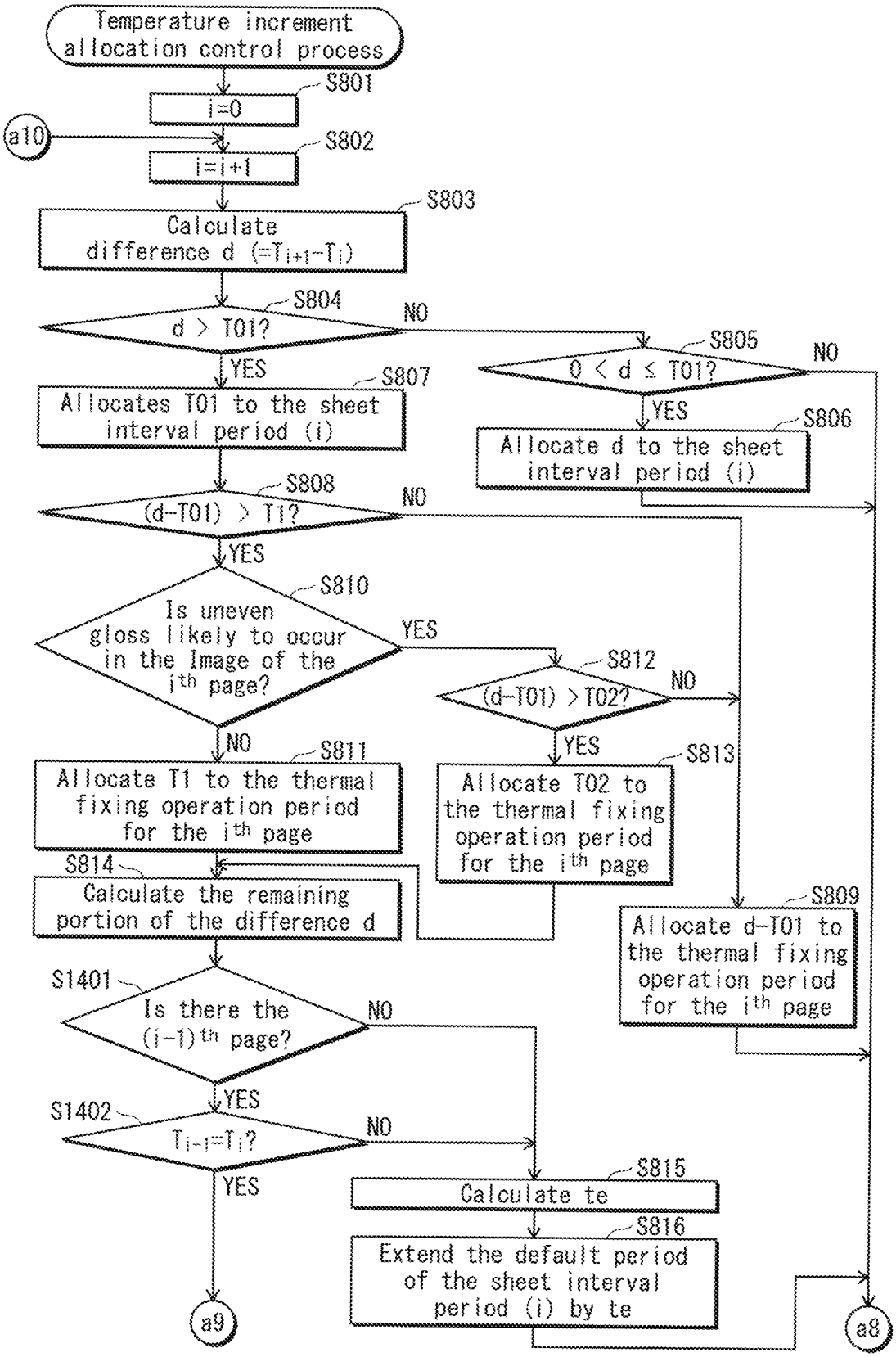
FIG. 17 is a flowchart illustrating a part of a temperature increment allocation control process pertaining to Modification 3, performed by the controller 60.
Figure 18:
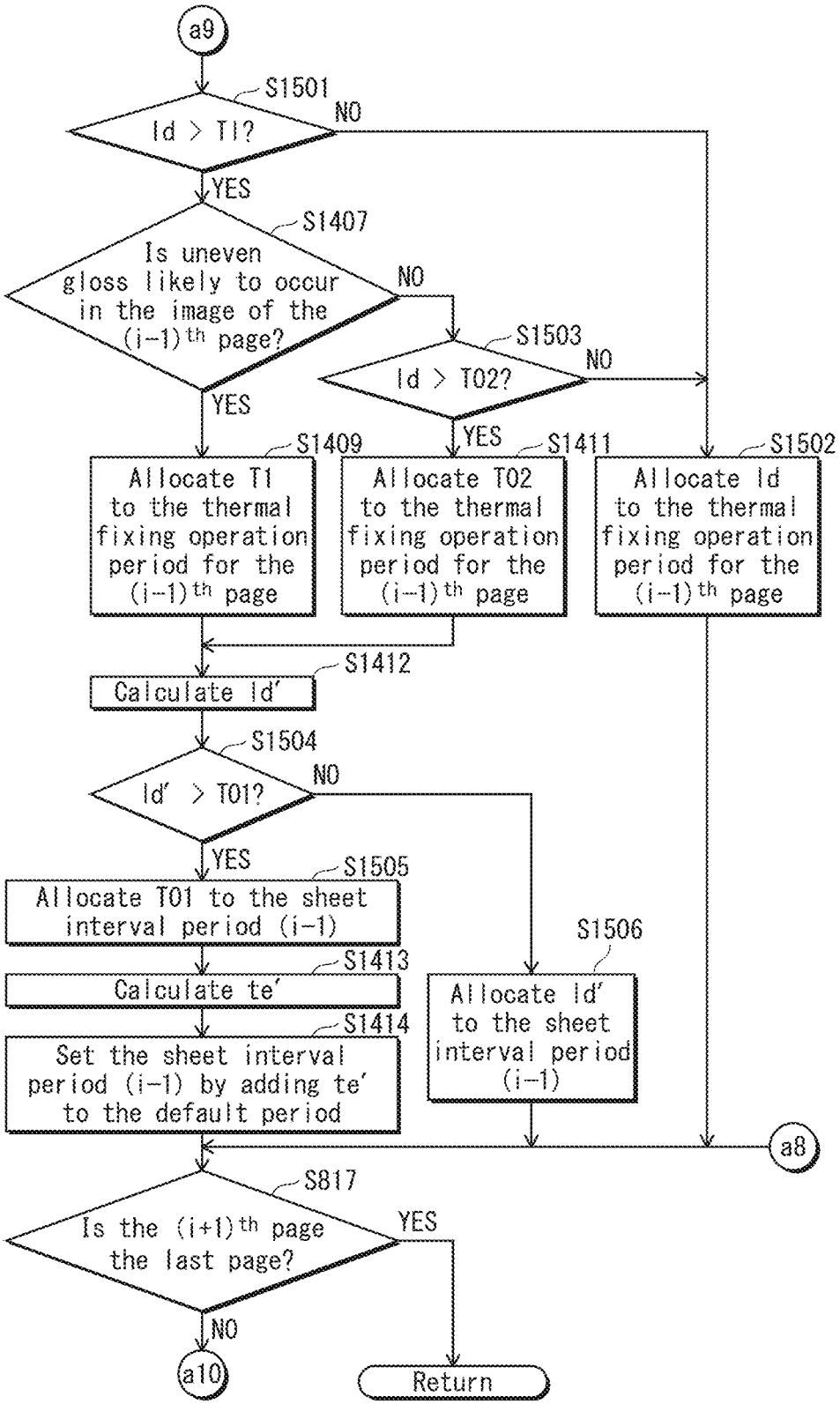
FIG. 18 is a flowchart illustrating the rest of the temperature increment allocation control process according to Modification 3, performed by the controller 60.

More specifically, the temperature increment allocation control process illustrated in FIG. 15 and FIG. 16 may be modified as illustrated in FIG. 17 and FIG. 18. FIG. 17 and FIG. 18 are flowcharts illustrating a temperature increment allocation control process pertaining to Modification 3, performed by the controller 60. Note that steps which are the same as in the temperature increment allocation control process illustrated in FIG. 15 and FIG. 16 are labeled using the same reference signs in FIG. 17 and FIG. 18, and explanation thereof is omitted. The following explanation focuses on differences compared to the process in FIG. 15 and FIG. 16.

When the outcome of the determination in Step S1402 is affirmative (Step S1402: YES), the controller 60 performs a determination as to whether the remaining portion (1*d*) calculated in Step S814 is greater than the maximum value (T1) corresponding to the highest level of acceptable uneven gloss (Step S1501).

When the outcome of the determination in Step S1501 is negative (Step S1501: NO), the controller 60 reserves, as the period for raising the temperature by the remaining portion of the increment, the thermal fixing operation period for the $(i-1)^{th}$ page, and allocates the increment that is equal to the remaining portion (1*d*) calculated in Step S814 to the thermal fixing operation period (Step S1502). The controller 60 then proceeds to Step S817.

When the outcome of the determination in Step S1501 is affirmative (Step S1501: YES), the controller 60 performs the determination in Step S1407. When the outcome of the determination in Step S1407 is affirmative (Step S1407: YES), the controller 60 proceeds to Step S1409 and Step S1412.

When the outcome of the determination in Step S1407 is negative (Step S1407: NO), the controller 60 performs a determination as to whether the remaining portion (1*d*) calculated in Step S814 is greater than the maximum possible value (T02) of the thermal fixing period temperature increment (Step S1503). When the outcome is affirmative (Step S1503: YES), the controller 60 proceeds to Step S1411 and Step S1412. When the outcome is negative (Step S1503: NO), the controller 60 proceeds to Step S1502 and Step S817.

After performing the processing in Step S1412, the controller 60 performs a determination as to whether the remaining portion (1*d*') calculated in Step S1412 is greater than the maximum possible value (T01) of the sheet interval temperature increment (Step S1504). When the outcome is affirmative (Step S1504: YES), the controller 60 reserves, as a period for raising the temperature by a portion of the remaining portion (1*d*'), the sheet interval period (i−1) corresponding to the interval between the $(i-1)^{th}$ page and the $i^{th}$ page, and allocates an increment that is equal to the maximum possible value (T01) of the sheet interval temperature increment to the sheet interval period (i−1) (Step S1505). The controller then proceeds to Step S1413, Step S1414, and Step S817.

When the outcome of the determination in Step S1504 is negative (Step S1504: NO), the controller 60 reserves, as the period for increasing the temperature by the remaining portion (1*d*'), the sheet interval period (i−1) corresponding to the interval between the $(i-1)^{th}$ page and the $i^{th}$ page, and allocates an increment that is equal to the remaining portion (1*d*') calculated in Step S1412 to the sheet interval period (i−1) (Step S1506). Then the controller 60 proceeds to Step S817.

According to Modifications described in (2), even when the difference d between the target fixing temperatures of a given page and its succeeding page is greater than the maximum possible value (T01) of the sheet interval temperature increment and it is therefore impossible to allocate the difference d in full to the thermal fixing operation period for the given page and thereby raise the fixing temperature by the difference d, if the preceding page to the given page has the same target fixing temperature as the given page, the sheet interval period corresponding to the interval between these two pages or the thermal fixing operation period for the preceding page is newly reserved as the period for increasing the temperature by the remaining portion of the increment, and the remaining portion is allocated to these periods. Therefore, it is possible to shorten or eliminate the sheet interval extension time for raising the remaining portion of the increment.

As a result, when there is a page that immediately precedes the given page and has the same target fixing temperature as the given page, this modification furthermore improves the productivity in printing accompanied with a process of raising the fixing temperature compared to Embodiment above.

(3) In the two modifications explained in (2) and illustrated in FIG. 15 and FIG. 16 and in FIG. 17 and FIG. 18, when the outcome of the determination in Step S1407 is affirmative, Steps S1201 to S1207 of the modification described in (1) may be performed, and the increments during the thermal fixing operation period for the $(i-1)^{th}$ page may be allocated to each of the divisional areas of the $(i-1)^{th}$ page.

(4) According to the fixing temperature control process pertaining to Embodiment, when the difference between the target fixing temperatures of a given page and its succeeding page is greater than the maximum possible value (T01) of the sheet interval temperature increment, a portion of the increment corresponding to the difference is allocated to the thermal fixing operation period for the given page. However, even when the difference is not greater than T01, a portion of the increment corresponding to the difference may be allocated to the thermal fixing operation period. This modification is applicable to the modifications described in (1) through (3) above.

(5) In Embodiment and the modifications described in (1) through (4) above, whether an image in a page or a divisional area is an image in which uneven gloss is likely to occur (or an image in which uneven gloss is not likely to occur) is determined based on whether the image is a text image or not. However, this determination may be made by another method.

For example, the determination may be made based on the amount of toner adhering to the page or the divisional area. Specifically, an image is determined to be an image in which uneven gloss is likely to occur when the adhering toner amount is greater than a threshold value, and to be an image in which uneven gloss is unlikely to occur when the adhering toner amount is not greater than the threshold value. The threshold value used for this determination may be determined by tests conducted in advance by the manufacturer of the printer 1, for example.

Alternatively, the determination may be made on whether the image in the page or the divisional area is a color image or not. For example, a color image may be determined to be an image in which uneven gloss is likely to occur, and a non-color image may be determined to be an image in which uneven gloss is unlikely to occur. Note that "a color image" may be an image including a color image section (e.g. an image including a color image section and a monochrome image section).

The determination as to whether the image is a color image or not can be mad based on the number of toner application pixels of each of Y, M, C and K colors, which is obtained through the image processing. Specifically, when the number of toner application pixels of each of Y, M and C colors is 0, the image is determined to be "a non-color image", and when the number of toner application pixels is not 0 with respect to any of the Y, M, C colors, the image is determined to be "a color image".

(6) In Embodiment above, the process of raising the temperature during the thermal fixing operation period by supplying power to the heater 57 is started when the leading end of the image area of the recording sheet of the target page reaches the fixing nip n (Step S1003: YES). However, the timing of starting the process of raising the temperature during the thermal fixing operation period is not limited to the beginning of the thermal fixing operation period. The process of raising the temperature may be started in the middle of the thermal fixing operation period if the amount of power required for the increment allocated in Step S1005 can be supplied to the heater 57.

SUMMARY

One aspect of the present invention described above is an image forming apparatus that forms toner images sequentially on a plurality of recording sheets transported with a sheet interval therebetween, and thermally fixes the toner images by passing the recording sheets through a fixing position on a heating roller, comprising: an image information acquisition unit that acquires image information of an image on each of a plurality of pages to be printed; a fixing temperature determination unit that determines a target fixing temperature for each of the plurality of pages according to the image information, the target fixing temperature being a temperature at which a surface temperature of the heating roller is to be maintained during a thermal fixing operation for the corresponding page; and a temperature control unit that controls the surface temperature of the heating roller, wherein when the fixing temperature determination unit determines the target fixing temperature for a given page to be a first temperature and the target fixing temperature for a succeeding page that immediately succeeds the given page to be a second temperature that is higher than the first temperature, and when a difference between the first temperature and the second temperature is greater than a predefined value, the temperature control unit reserves part or all of a first period, and a second period, the first period being a period during which the thermal fixing operation for the given page is performed, the second period being a period corresponding to a sheet interval between the given page and the succeeding page, the reserved periods serving as periods for raising the surface temperature of the heating roller by an amount that is equal to the difference, and the temperature control unit performs temperature control during the reserved periods such that the surface temperature reaches the second temperature before a start of the thermal fixing operation for the succeeding page.

With the stated structure, when the target fixing temperature for the succeeding page to the given page is higher than the target fixing temperature for the given page, and the difference between these target fixing temperatures is greater than a predefined value, part or all of the first period (i.e. the thermal fixing period) during which the thermal fixing operation for the given page is performed, and the second period (i.e. the sheet interval period) corresponding to the sheet interval between the given page and the succeeding page, are reserved as periods for raising the surface temperature of the heating roller by an amount that is equal to the difference. Therefore, even when the difference between the target fixing temperatures is large, the temperature increment during the sheet interval period can be reduced due to the temperature increment during part or all of the thermal fixing period. As a result, the stated structure reduces the waiting time caused by the operations for raising the fixing temperature during the sheet interval, and improves the productivity in printing The predefined value may be a maximum possible value of an increment of the surface temperature of the heating roller during the second period when the sheet interval has a predefined size.

When the reserved periods are not sufficient to raise the surface temperature by the difference in full under the condition that the sheet interval has the predefined size, the temperature control unit may increase the sheet interval in size by an amount corresponding to a remaining portion of the difference.

The determination unit may perform the determination based on whether the image information indicates a text image or a non-text image, and determine that uneven gloss is likely to occur when the image information indicates a non-text image. Alternatively, the determination unit may calculate an amount of toner adhering to the given page, perform the determination based on whether the amount of toner is greater than a predefined threshold value, and determine that uneven gloss is likely to occur when the amount of toner is greater than the predefined threshold value.

Alternatively, the determination unit may perform the determination based on whether the image information indicates a color image or a non-color image, and determines that uneven gloss is likely to occur when the image information indicates a color image.

The image forming apparatus may further comprise: a determination unit that performs a determination as to whether uneven gloss is likely to occur in an image on the given page by referencing the image information of the image on the given page, wherein when the determination unit determines that uneven gloss is likely to occur in the image on the given page, the temperature control unit may reduce, by an adjustment amount, an increment of the surface temperature during the part or all of the first period, thereby preventing the increment of the surface temperature from exceeding a maximum value corresponding to a highest level of acceptable uneven gloss, and increase the increment of the surface temperature during the second period by the adjustment amount.

With the stated structure, a determination is performed as to whether uneven gloss is likely to occur in an image on the given page, and when determination is made that uneven gloss is likely to occur in the image on the given page, the increment of the surface temperature during the part or all of the first period is reduced by an adjustment amount so that the increment of the surface temperature does not exceed a maximum value corresponding to a highest level of acceptable uneven gloss, and the increment of the surface temperature during the second period is increased by the adjustment amount. Therefore, the stated structure prevents occurrence of uneven gloss in the given page even when the surface temperature is increased during the part or all of the first period for the given page.

The image forming apparatus may further comprise: a determination unit that performs, for each of a plurality of areas of the given page contiguous along a sheet transport direction, a determination as to whether uneven gloss is likely to occur in an image in the area by referencing the image information of the image on the given page, wherein when the determination unit determines that uneven gloss is likely to occur in the image in the area, the temperature control unit may perform the temperature control by reducing, by an adjustment amount, the increment of the surface temperature during a part of the first period corresponding to the area, thereby preventing the increment of the surface temperature from exceeding a maximum value corresponding to a highest level of acceptable uneven gloss, and increasing the increment of the surface temperature during the second period by the adjustment amount.

With the stated structure, a determination is made for each of a plurality of areas of the given page contiguous along a sheet transport direction, as to whether uneven gloss is likely to occur in an image in the area, and when determination is made that uneven gloss is likely to occur in the image in the area, the increment of the surface temperature during a part of the first period, that corresponds to the area, is reduced by an adjustment amount, and the increment of the surface temperature during the second period is increased by the adjustment amount. Therefore, the stated structure prevents occurrence of uneven gloss in the given page even when the surface temperature is increased during the part or all of the first period for the given page.

Furthermore, when determination is made that uneven gloss is unlikely to occur in the image in the area, the increment of the surface temperature during the part of the first period corresponding to the area can be greater than the maximum value corresponding to the highest level of acceptable uneven gloss. Accordingly, when the given page includes an image in which uneven gloss is likely to occur, it is possible to increase the rate of temperature rise compared to the case where the determination is performed for each entire page, because of the increase of the increment of the surface temperature during the part of the first period corresponding to the area in which uneven gloss is unlikely to occur.

Therefore, the stated structure can reduce the increment to be allocated to the sheet interval period. As a result, the stated structure reduces the waiting time caused by the operations for raising the fixing temperature during the sheet interval, and improves the productivity in printing When the fixing temperature determination unit determines that the target fixing temperature for the given page is equal to the target fixing temperature for a preceding page that immediately precedes the given page, and the reserved periods are not sufficient to raise the surface temperature by the difference in full, the temperature control unit may additionally reserve at least one of a third period and a fourth period, and perform the temperature control, the third period being a period corresponding to a sheet interval between the preceding page and the given page, the fourth period being a period during which the thermal fixing operation for the preceding page is performed, and at least one of the third period and the fourth period serving as a period for raising the surface temperature by a remaining portion of the difference.

With the stated structure, when the target fixing temperature for the given page is equal to the target fixing temperature for the preceding page to the given page, and the reserved periods are not sufficient to raise the surface temperature by the difference in full, at least one of (i) a third period corresponding to a sheet interval between the preceding page and the given page, and (ii) a fourth period during which the thermal fixing operation for the preceding page is performed, is reserved as periods for raising the surface temperature of the heating roller by a remaining portion of the difference. Therefore, it is possible to raise the surface temperature of the heating roller to the target fixing temperature of the succeeding page without extending the sheet interval period.

Consequently, when there is a page that immediately precedes the given page and that has the same target fixing temperature as the given page, it is possible to reduce the waiting time caused by the operations for raising the fixing temperature between the pages, to be shorter than in the case where there is no preceding page, and improve the productivity in printing.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

The invention claimed is:

1. An image forming apparatus that forms toner images sequentially on a plurality of recording sheets transported with a sheet interval therebetween, and thermally fixes the toner images by passing the recording sheets through a fixing position on a heating roller, comprising:

an image information acquisition unit that acquires image information of an image on each of a plurality of pages to be printed;

a fixing temperature determination unit that determines a target fixing temperature for each of the plurality of pages according to the image information, the target fixing temperature being a temperature at which a surface temperature of the heating roller is to be maintained during a thermal fixing operation for the corresponding page; and a temperature control unit that controls the surface temperature of the heating roller, wherein when the fixing temperature determination unit determines the target fixing temperature for a given page to be a first temperature and the target fixing temperature for a succeeding page that immediately succeeds the given page to be a second temperature that is higher than the first temperature, and when a difference between the first temperature and the second temperature is greater than a predefined nonzero value, the temperature control unit reserves part or all of a first period and a second period, the first period being a period during which the thermal fixing operation for the given page is performed, the second period being a period corresponding to a sheet interval between the given page and the succeeding page, the reserved periods serving as periods for raising the surface temperature of the heating roller by an amount that is equal to the difference, and the temperature control unit performs temperature control during the reserved periods such that the surface temperature reaches the second temperature before a start of the thermal fixing operation for the succeeding page, and when the difference between the first temperature and the second temperature is less than or equal to the predefined nonzero value, the temperature control unit reserves no part of the first period and part or all of the second period to serve as the period for raising the surface temperature.

2. The image forming apparatus of claim 1, wherein the predefined value is a maximum possible value of an increment of the surface temperature of the heating roller during the second period when the sheet interval has a predefined size.

3. An image forming apparatus that forms toner images sequentially on a plurality of recording sheets transported with a sheet interval therebetween, and thermally fixes the toner images by passing the recording sheets through a fixing position on a heating roller, comprising:

an image information acquisition unit that acquires image information of an image on each of a plurality of pages to be printed;

a fixing temperature determination unit that determines a target fixing temperature for each of the plurality of pages according to the image information, the target fixing temperature being a temperature at which a surface temperature of the heating roller is to be maintained during a thermal fixing operation for the corresponding page; and a temperature control unit that controls the surface temperature of the heating roller, wherein when the fixing temperature determination unit determines the target fixing temperature for a given page to be a first temperature and the target fixing temperature for a succeeding page that immediately succeeds the given page to be a second temperature that is higher than the first temperature, and when a difference between the first temperature and the second temperature is greater than a predefined value, the temperature control unit reserves part or all of a first period and a second period, the first period being a period during which the thermal fixing operation for the given page is performed, the second period being a period corresponding to a sheet interval between the given page and the succeeding page, the reserved periods serving as periods for raising the surface temperature of the heating roller by an amount that is equal to the difference, and the temperature control unit performs temperature control during the reserved periods such that the surface temperature reaches the second temperature before a start of the thermal fixing operation for the succeeding page, the image forming apparatus further comprises a determination unit that performs a determination as to whether uneven gloss is likely to occur in an image on the given page by referencing the image information of the image on the given page, and when the determination unit determines that uneven gloss is likely to occur in the image on the given page, the temperature control unit reduces, by an adjustment amount, an increment of the surface temperature during the part or all of the first period, thereby preventing the increment of the surface temperature from exceeding a maximum value corresponding to a highest level of acceptable uneven gloss, and increases the increment of the surface temperature during the second period by the adjustment amount.

4. An image forming apparatus that forms toner images sequentially on a plurality of recording sheets transported with a sheet interval therebetween, and thermally fixes the toner images by passing the recording sheets through a fixing position on a heating roller, comprising:

an image information acquisition unit that acquires image information of an image on each of a plurality of pages to be printed;

a fixing temperature determination unit that determines a target fixing temperature for each of the plurality of pages according to the image information, the target fixing temperature being a temperature at which a surface temperature of the heating roller is to be maintained during a thermal fixing operation for the corresponding page; and a temperature control unit that controls the surface temperature of the heating roller, wherein when the fixing temperature determination unit determines the target fixing temperature for a given page to be a first temperature and the target fixing temperature for a succeeding page that immediately succeeds the given page to be a second temperature that is higher than the first temperature, and when a difference between the first temperature and the second temperature is greater than a predefined value, the temperature control unit reserves part or all of a first period and a second period, the first period being a period during which the thermal fixing operation for the given page is performed, the second period being a period corresponding to a sheet interval between the given page and the succeeding page, the reserved periods serving as periods for raising the surface temperature of the heating roller by an amount that is equal to the difference, and the temperature control unit performs temperature control during the reserved periods such that the surface temperature reaches the second temperature before a start of the thermal fixing operation for the succeeding page, the image forming apparatus further comprises a determination unit that performs, for each of a plurality of areas of the given page contiguous along a sheet transport direction, a determination as to whether uneven gloss is likely to occur in an image in the area by referencing the image information of the image on the given page, and when the determination unit determines that uneven gloss is likely to occur in the image in the area, the temperature control unit performs the temperature control by reducing, by an adjustment amount, an increment of the surface temperature during a part of the first period corresponding to the area, thereby preventing the increment of the surface temperature from exceeding a maximum value corresponding to a highest level of acceptable uneven gloss, and increasing the increment of the surface temperature during the second period by the adjustment amount.

5. The image forming apparatus of claim 2, wherein when the fixing temperature determination unit determines that the target fixing temperature for the given page is equal to the target fixing temperature for a preceding page that immediately precedes the given page, and the reserved periods are not sufficient to raise the surface temperature by the difference in full, the temperature control unit additionally reserves at least one of a third period and a fourth period, and performs the temperature control, the third period being a period corresponding to a sheet interval between the preceding page and the given page, the fourth period being a period during which the thermal fixing operation for the preceding page is performed, and at least one of the third period and the fourth period serving as a period for raising the surface temperature by a remaining portion of the difference.

6. The image forming apparatus of claim 2, wherein when the reserved periods are not sufficient to raise the surface temperature by the difference in full under the condition that the sheet interval has the predefined size, the temperature control unit increases the sheet interval in size by an amount corresponding to a remaining portion of the difference.

7. The image forming apparatus of claim 3, wherein the determination unit performs the determination based on whether the image information indicates a text image or a non-text image, and determines that uneven gloss is likely to occur when the image information indicates a non-text image.

8. The image forming apparatus of claim 3, wherein the determination unit calculates an amount of toner adhering to the given page, performs the determination based on whether the amount of toner is greater than a predefined threshold value, and determines that uneven gloss is likely to occur when the amount of toner is greater than the predefined threshold value.

9. The image forming apparatus of claim 3, wherein the determination unit performs the determination based on whether the image information indicates a color image or a non-color image, and determines that uneven gloss is likely to occur when the image information indicates a color image.

10. The image forming apparatus of claim 1 further comprising:

a determination unit that performs a determination as to whether uneven gloss is likely to occur in an image on the given page by referencing the image information of the image on the given page, wherein when the determination unit determines that uneven gloss is likely to occur in the image on the given page, the temperature control unit reduces, by an adjustment amount, an increment of the surface temperature during the part or all of the first period, thereby preventing the increment of the surface temperature from exceeding a maximum value corresponding to a highest level of acceptable uneven gloss, and increases the increment of the surface temperature during the second period by the adjustment amount.

* * * * *